US008879765B2

(12) United States Patent
Aoki et al.

(10) Patent No.: US 8,879,765 B2
(45) Date of Patent: Nov. 4, 2014

(54) HEARING OPTIMIZATION DEVICE AND HEARING OPTIMIZATION METHOD

(75) Inventors: Kikuo Aoki, Tokyo (JP); Keisuke Oizumi, Tokyo (JP); Masahiko Ohgushi, Saitama (JP); Keiichi Kato, Kanagawa (JP)

(73) Assignees: Bicera Co., Ltd., Miyamae-ku, Kawasaki-shi, Kanagawa (JP); MIMY Electronics Co., Ltd., Tachikawa-shi, Tokyo (JP)

( * ) Notice: Subject to any disclaimer, the term of this patent is extended or adjusted under 35 U.S.C. 154(b) by 1608 days.

(21) Appl. No.: 12/310,063

(22) PCT Filed: Aug. 11, 2006

(86) PCT No.: PCT/JP2006/315907

§ 371 (c)(1),
(2), (4) Date: Sep. 30, 2009

(87) PCT Pub. No.: WO2008/018146

PCT Pub. Date: Feb. 14, 2008

(65) Prior Publication Data

US 2010/0254551 A1 Oct. 7, 2010

(30) Foreign Application Priority Data

Aug. 10, 2006 (JP) ..... 2006-217680

(51) Int. Cl.
*H04R 25/00* (2006.01)
*H04R 1/10* (2006.01)

(52) U.S. Cl.
CPC ..... *H04R 25/505* (2013.01); *H04R 1/1083* (2013.01); *H04R 1/1091* (2013.01); *H04R 2225/41* (2013.01); *H04R 25/70* (2013.01); *H04R 2201/107* (2013.01)
USPC ..... 381/320; 381/312; 381/321

(58) Field of Classification Search
USPC ..... 381/57, 98–99, 101–104, 107, 109, 381/312–331
See application file for complete search history.

(56) References Cited

U.S. PATENT DOCUMENTS 4,393,275 A * 7/1983 Feldman et al. ..... 381/320

FOREIGN PATENT DOCUMENTS

| | | | |
|---|---|---|---|
| JP | 4-372299 | A | 12/1992 |
| JP | 6-177688 | A | 6/1994 |
| JP | 10-126893 | A | 5/1998 |
| JP | 10-126894 | A | 5/1998 |
| JP | 2001-359195 | A | 12/2001 |
| JP | 2005-173055 | A | 6/2005 |

* cited by examiner

*Primary Examiner* — Matthew Eason
(74) *Attorney, Agent, or Firm* — Bacon & Thomas, PLLC

(57) ABSTRACT

A hearing optimization device and hearing optimization method having a high boost frequency characteristic reference live for high frequency range enhancement and a low boost frequency characteristic reference live for low frequency range enhancement to achieve separate gain control of input audio signal according to frequency. An audio signal processing and generating means is also included, along with synthesized audio signal output structure.

18 Claims, 35 Drawing Sheets

An Embodiment of Construction of a Hearing Aid

An embodiment of Construction of a Mobile Phone

Another Embodiment of Construction of a Hearing Aid

Another Embodiment of Construction of a Mobile Phone

HEARING OPTIMIZATION DEVICE AND HEARING OPTIMIZATION METHOD

FIELD OF THE INVENTION

The present invention relates to hearing optimization device and hearing optimization method, which are hearing optimization technologies adjustable to hearing characteristic of an individual and his/her hearing situation (including sound environment such as noises), the technologies being designed to be adjustable to hearing of the individual who may be a person with impaired hearing or one with normal hearing, whereby he/she can enjoy clear, comfortable and smooth conversation (including telephone conversation) in any kind of situation.

BACKGROUND OF THE INVENTION

A various conventional hearing aids, designed for hearing impaired persons, have been proposed. However, hearing differs greatly between individuals, and also it is affected from time to time by other factors such as physical condition of a user and his/her sound environment.

Solutions have been addressed to aid hearing impairment in such a way that hearing characteristic of an individual hearing impaired user is measured at specific frequency ranges using an audiometer or the like for example, the result being used to calculate preferable correction and output characteristic for a hearing aid, so that the hearing impaired user can select a hearing aid which provides preferable characteristic (by controlling output for specific frequency ranges) to him/her, or he/she can adjust characteristic on the hearing aid. However, such methods have their own limits because of the difficulty to measure hearing impairment condition or such precisely by using a measuring instrument.

For example, in Japanese published unexamined application No. 2000-165483, because of the possible audible difficulty for a hearing impaired user, a digital phone adjusts its audio output comprising steps including: a step wherein a user parameter, which represents haring spectrum of an individual user, is obtained; a step wherein digital input signal, which represents information heard by a user, is received; a step wherein, in order to generate hearing-adjusted digital signal, digital input signal is adjusted according to the user parameter; and a step wherein analog output signal is generated based on the hearing-adjusted digital signal. However, a special place and highly complicated processes are required in order to obtain hearing characteristic of impaired persons.

Moreover, individual hearing impaired persons would go to various places in their daily lives, which situation requires correction adjustment over output characteristic of a hearing aid, corresponding to sound environment of the place where the user is in, because hearing characteristic is subject to the present sound environment. However, the fact is that there was no such device which can be easily adjusted to the aforementioned situation.

Also, hearing is affected by physical condition of an individual and so on, so that correction over the similar output characteristic to that of the last time may not necessarily work out the best even if the sound environment is the same as before.

Further issue is that hearing is of human aesthesia, so that it is only understood by a hearer and difficult to explain verbally to other people including doctors and specialists. However, in order to measure the hearer's hearing characteristic, his/her personal perception, which cannot be shared with anyone else, needs to be taken out, which is very difficult to do.

An ideal but not realistic solution is a hearing aid being provided with an equalizer, which can adjust input audio corresponding to each user, place, and time, for each user to adjust at the place and time of use of the device. Very possibly this issue would also suffer persons with normal hearing that in noisy environment voice of other people as well as other sounds are hard to hear, resulting in unsmooth conversation, including telephone conversation.

Also one of other demands, in audio field including music listening for example, is for preferable acoustic characteristic which can be adjusted by means of adjusting frequency continuously over various frequency ranges of sound source, corresponding to hearing characteristic of an individual, a place or other factors.

Patent Document 1: Japanese published unexamined application No. 2000-165483

DISCLOSURE OF THE INVENTION

Problems to be Solved by the Invention

There has been a demand for hearing optimization device and method which can be adjusted easily by an individual user corresponding to his/her hearing characteristic of the day, his/her sound environment, and so on. Conventional hearing aids for hearing impaired persons are designed to measure hearing characteristic by using a special measuring device or the like, to adjust output characteristic suited for the hearer. However, as aforementioned, hearing of an individual is not only being accurately understood by the hearer alone but also differs according to his/her physical condition and the place he/she is in. Therefore, conventional technologies have not necessarily been satisfactory.

Likewise, even persons with normal hearing have sometimes suffered from insufficient voice output of a person on the other side of a mobile phone, or the like, which is used in various outdoor situations, of which usability can be greatly improved if optimized voice output can be heard according to factors such as the place where it is used. Specifically, in noisy environment such as airport or railway station, by easy adjustment to hearing characteristic of the mobile phone user in accordance with his/her sound environment, conversation over mobile phone can be easy in a bad sound environment.

Particularly, hearing (how a sound is heard) is a perceptive matter, and is neither easy to explain verbally to other people nor measurable without limitation by an equipment, therefore a hearer needs some kind of means he can easily adjust. Such an adjustable means is what easily adjusts a difference between individuals and/or sound environments.

Moreover, for audio equipment and the like, if there is a continuous adjustment mechanism, more corresponding adjustment to human hearing than before becomes available.

Means of Solving the Problems

The present invention, in view of the aforementioned conventional drawbacks, provides hearing optimization device and hearing optimization method such as hearing aid and mobile phone, wherein optimization and correction can be easily done corresponding to hearing of each high frequency range and low frequency range without changing output loudness (perceptive sound volume) of audio signal, and further wherein being combined with a user-adjustable technology whereby a hearer can adjust by him/herself while hearing or listening.

In order to solve the aforementioned issues, the inventors of this present invention have adopted the following means after keen examination. That is, in order for separate gain control of input audio signal according to frequency, the present invention is preliminarily provided with a high boost (high frequency boosting) frequency characteristic reference line (DEFINITION: reference line according to which increase and decrease amount of gain of the original audio signal according to frequency range is determined) for high frequency range enhancement and a low boost (low frequency boosting) frequency characteristic reference line for low frequency range enhancement.

The present invention is also provided with an audio signal processing and generating means (DEFINITION: means by which, a single frequency is dual distributed, one for high frequency enhancement and the other for low frequency enhancement, each of which references its corresponding frequency characteristic reference line, and generates the original audio signals), whereby the input audio signal is dual distributed, and the two audio signal processings are carried out for the high boost (high frequency boosting) audio signal to enhance a high frequency range according to the high boost (high frequency boosting) frequency characteristic reference line and the low boost (low frequency boosting) audio signal to enhance a low frequency range according to the low boost (low frequency boosting) frequency characteristic reference line.

The present invention is further provided with: the synthesized audio signal output means, wherein the two input audio signals are generated by the audio signal processing and generating means to be used as an audio signal output; and a synchronous adjustment means for the high boost (high frequency boosting) frequency characteristic reference line and the low boost (low frequency boosting) frequency characteristic reference line to synchronously adjust the two characteristic reference lines—namely the high boost (high frequency boosting) frequency characteristic reference line and the low boost (low frequency boosting) frequency characteristic reference line—by a pair of adjustment means. The high boost (high frequency boosting) frequency characteristic reference line and the low boost (low frequency boosting) frequency characteristic reference lines are crossed at a memorized frequency.

Synchronous enhancement is carried out by changing inclinations of the high boost (high frequency boosting) frequency characteristic reference line and the low boost (low frequency boosting) frequency characteristic reference line, the crossing point being a rotation center. A memorized crossing frequency range for the high boost (high frequency boosting) frequency characteristic reference line and the low boost (low frequency boosting) frequency characteristic reference line is between 500 Hz and 2 kHz.

As aforementioned, the adjustment means, which synchronously adjusts the high boost (high frequency boosting) frequency characteristic reference line and the low boost (low frequency boosting) frequency characteristic reference line with each other, adjusts said high boost (high frequency boosting) frequency characteristic reference line and said low boost (low frequency boosting) frequency characteristic reference line in symmetrical inclination to each other, the crossing point being a center where the high boost (high frequency boosting) frequency characteristic reference line and the low boost (low frequency boosting) characteristic reference line are crossed with each other at a memorized frequency. In this way, easy simultaneous enhancement is possible by a pair of adjustment means for the high frequency range and the low frequency range.

Described hereinafter is a method on how to make automatic adjustment. The present invention is provided with: an input audio signal analysis and memory means, whereby the input audio signal is analyzed and input audio situation is memorized; a memory means for input audio situation and inclinations of high boost (high frequency boosting) and low boost (low frequency boosting) frequency characteristic reference lines, which memorizes inclinations of high boost (high frequency boosting) frequency characteristic reference line and low boost (low frequency boosting) frequency characteristic reference line, adjusted by a user using the adjustment means, simultaneously with the input audio signal analysis and memory means; and an automatic adjustment means for inclinations of high boost (high frequency boosting) and low boost (low frequency boosting) frequency characteristic reference lines, whereby the input audio signal is analyzed, and whereby an audio situation pattern similar to that of corresponding input audio situation is selected from the memory means for input audio situation and inclinations of high boost (high frequency boosting) and low boost (low frequency boosting) frequency characteristic reference lines, and whereby inclinations of the high and low boost (high and low frequency boosting) frequency characteristic reference lines are determined without any user adjustment.

In this way, a user can obtain clear and comfortable audio signal output without any adjustment when he/she is in the same sound environment.

The automatic inclination adjustment means for the high boost (high frequency boosting) and low boost (low frequency boosting) frequencies reference lines is provided with a learning function, so that optimized inclinations for high boost (high frequency boosting) and low boost (low frequency boosting) characteristic reference lines can be obtained more easily and automatically as memories are accumulated for places where the user is likely to go to. The analysis means to analyze the input audio signal is a frequency analysis means.

Or possibly, the present invention is provided with: an input audio signal analysis means to analyze the input audio signal and to recognize the input audio situation; and/or a memory means for inclinations of the high boost (high frequency boosting) and low boost (low frequency boosting) frequency characteristic reference lines corresponding to memorized input audio situation, wherein inclinations of the high boost (high frequency boosting) frequency characteristic reference line and the low boost (low frequency boosting) characteristic reference line are preliminarily memorized. In this case, inclinations of high boost (high frequency boosting) and low boost (low frequency boosting) frequency characteristic reference lines are memorized, using preliminarily gathered data from average persons with normal hearing, suitable for each memorized sound environment. The analysis means to analyze the audio signal is a frequency analysis means.

Described hereinbefore is a method on how to simultaneously adjust two frequency characteristic reference lines (high boost (high frequency boosting) and low boost (low frequency boosting)), each for high frequency range and low frequency range. Described hereinafter is about a method on how to enhance core voice frequencies in human conversations.

The present invention is preliminary provided with: frequency characteristic reference lines in order to gain control an input audio signal according to frequency; and an audio signal processing and generating means to gain control the input audio signal according to the frequency characteristic reference lines.

The frequency characteristic reference lines are provided with an adjustment means which adjusts inclinations of frequency characteristic reference lines, wherein a reference frequency is a rotation center. The reference frequency range of the rotation center is between 500 Hz and 2 kHz.

The aforementioned description is about the method on how to automatically adjust a high frequency range and a low frequency range, i.e. the two frequency characteristic reference lines (high boost (high frequency boosting) and low boost (low frequency boosting)), simultaneously.

Described hereinafter is a method on how to automatically adjust single frequency characteristic reference line. The present invention is provided with: the input audio signal analysis and memory means to analyze the input audio signal and memorize the input audio situation; a memory means for input audio situation and inclinations of frequency characteristic reference lines, whereby inclinations of frequency characteristic reference lines adjusted by a user using the adjustment means are memorized simultaneously with aforementioned input audio signal analysis and memory means; and an automatic adjustment means for inclinations, whereby input audio signal is analyzed, corresponding input audio situation is selected from the memory means for input audio situation and inclinations, and whereby inclinations of the frequency characteristic reference lines are determined without any user adjustment.

The automatic inclination adjustment means for frequency characteristic reference line is more useful by providing a learning function. The analysis means to analyze the input audio signal is a frequency analysis.

Or possibly, the present invention is provided with: an input audio signal analysis means to analyze the input audio signal and to recognize input audio situation; and a memory means for inclinations of frequency characteristic reference lines corresponding to input audio situation, whereby inclinations of frequency characteristic reference lines, corresponding to the memorized audio situation, are preliminarily memorized. Just like the aforementioned case of two frequency characteristic reference lines, inclinations of high boost (high frequency boosting) and low boost (low frequency boosting) frequency characteristic reference lines are memorized, using preliminarily gathered data from average persons with normal hearing, suitable for each memorized sound environment. Further likewise, the analysis means to analyze the input audio signal is a frequency analysis means.

Described hereinafter is a method on how to apply the aforementioned method to hearing aid. This method is applicable to both the former case of two frequency characteristic reference lines (high boost (high frequency boosting) and low boost (low frequency boosting)) and the latter case of single frequency characteristic reference line. The hearing optimization device and the hearing optimization method are applied to hearing aids.

Also, the adjustment means is controllable independently from an audio signal output adjustment means, wherein the audio signal output adjustment means and the adjustment means are adjusted by the same mechanical adjustment device, and further wherein the mechanical adjustment device is provided with either one of the audio signal output adjustment means, a volume control which selects the adjustment means, or the mechanical adjustment and selection means which controls and selects frequency.

The hearing aid has a unified construction attached to/in an ear, wherein the adjustment means is provided within the unified construction. Or possibly, the hearing aid is composed of a hearing aid remote control unit and an ear attachment unit, each of the hearing aid remote control unit and the ear attachment unit is provided with a communication means to communicate with each other either by wired or short-range radio communication, the adjustment means being provided within the hearing aid remote control unit.

Described hereinbefore is an application method to hearing aid.

Described hereinafter is an application method to communication device including mobile phone. This method is applicable to both the former case of two frequency characteristic reference lines (high boost (high frequency boosting) and low boost (low frequency boosting)) and the latter case of single frequency characteristic reference line. The aforementioned hearing optimization device and the hearing optimization method are applied to a telecommunication means. The telecommunication means is a telephone such as mobile phone and land line, or further can be site-specific telephone equipment such as intercommunication system.

The hearing optimization device and the telecommunication means are of unified construction, wherein the adjustment means is provided within the unified construction. Or possibly, the hearing optimization device is independent from the telecommunication means, and the hearing optimization device and the telecommunication means are interfaced with a wired or short-range radio communication means.

Described hereinafter is a further application for use in noisy environments. This method is applicable to both the former case of two frequency characteristic reference lines (high boost (high frequency boosting) and low boost (low frequency boosting)) and the latter case of single frequency characteristic reference line.

The hearing optimization device and the hearing optimization method are provided with: a background-noise adjustment means which decreases gain of a memorized frequency range of memorized background noises; and a background noise adaptation activation means with which a user can activate the background noise adaptation means over the input audio. In this way, a user can hear in good conditions in noisy environments by using the activation means freely.

Or possibly, in order to be used in noisy environments, the hearing optimization device and the hearing optimization method is provided with: a background-noise recognition means to measure whether or not any background-noise of a memorized frequency is present; a background-noise adjustment means which decreases gain of a memorized frequency range; and an automatic background-noise muting activation means to activate the background-noise adjustment means when the background-noise recognition means recognizes that there is some noise. In this way, background-noise adaptation is possible when memorized background-noise is identified. A memorized frequency range of the background noises for the background-noise adaptation means is between 20 Hz and 500 Hz, and preferably between 20 Hz and 200 Hz.

Described hereinafter is an adjustment method, adapted to factors such as personal hearing characteristic or locations, continuously corresponding to various frequency ranges.

In order for gain control according to frequency of input audio signal, the present invention is preliminarily provided with a high boost (high frequency boosting) frequency characteristic reference line to enhance a high frequency range and a low boost (low frequency boosting) frequency characteristic reference line to enhance a low frequency range, wherein two audio signals are generated by dual distributing the input audio signal, one of the dual distributed input audio signal being used as a high boost (high frequency boosting)

audio signal generated by a high boost (high frequency boosting) audio signal processing and generating means to enhance a high frequency range referring to the high boost (high frequency boosting) frequency characteristic reference line, and the other of the dual distributed input audio signal being used as a low boost (low frequency boosting) audio signal generated by a low boost (low frequency boosting) audio signal processing and generating means to enhance a low frequency range referring to the low boost (low frequency boosting) frequency characteristic reference line, and further provided with a synthesized audio signal output means, which makes an output audio signal by synthesizing two audio signals, which are: a high boost (high frequency boosting) audio signal coefficient-multiplying means which multiplies coefficient to adjust a ratio for synthesizing the high boost (high frequency boosting) audio signal with memorized two audio signals; and a low boost (low frequency boosting) audio signal coefficient-multiplying means which multiplies coefficient to adjust a ratio for synthesizing the low boost (low frequency boosting) audio signal with memorized two audio signals.

Audio signal synthesis becomes available by adjusting ratio of the high boost (high frequency boosting) audio signal and the low boost (low frequency boosting) audio signal in such a way that: the memorized coefficient for the high boost (high frequency boosting) audio signal is set by the high boost (high frequency boosting) coefficient input adjustment means; and, likewise, the memorized coefficient for the low boost (low frequency boosting) audio signal is set by the low boost (low frequency boosting) coefficient input adjustment means. Therefore, it becomes possible to output desired audio signal because the high boost (high frequency boosting) audio signal according to the high boost (high frequency boosting) frequency characteristic reference line and the low boost (low frequency boosting) audio signal according to the low boost (low frequency boosting) frequency characteristic reference line are adjustable at any desired ratio.

The high boost (high frequency boosting) frequency characteristic reference line is provided with an adjustment means for high boost (high frequency boosting) frequency characteristic reference line to adjust its inclination, a memorized frequency being as a rotation center, and the low boost (low frequency boosting) frequency characteristic reference line is provided with an adjustment means for low boost (low frequency boosting) frequency characteristic reference line to adjust its inclination, a memorized frequency being as a rotation center The present invention is further provided with: the high boost (high frequency boosting) center position adjustment means to adjust a center position, its rotation center being a memorized frequency for the high boost (high frequency boosting) frequency characteristic reference line; and the low boost (low frequency boosting) center position adjustment means to adjust a center position, its rotation center being a memorized frequency for the low boost (low frequency boosting) frequency characteristic reference line.

Greater adjustment flexibility is offered if the high boost (high frequency boosting) frequency characteristic reference line and the low boost (low frequency boosting) frequency characteristic reference line are adjusted independently from each other. A frequency range of a rotation center of the high boost (high frequency boosting) frequency characteristic reference line is between 1000 Hz and 8000 Hz, and a frequency range of a rotation center of the low boost (low frequency boosting) frequency characteristic reference line is between 400 Hz and 1000 Hz. By arranging this plurality of adjustments, frequency hearing environment becomes adjustable in continuous fashion, which is essential for audio equipments.

Described further hereinafter is a method, particularly a method to be added to the aforementioned mechanism, to arrange optimized hearing environment corresponding to audio input situation.

The present invention is provided with: an input audio signal analysis and memory means whereby the input audio signal is analyzed and the input audio situation is memorized; a memory means for input audio situation and inclinations of high boost (high frequency boosting) and low boost (low frequency boosting) frequency characteristic reference lines, whereby inclinations of the high boost (high frequency boosting) frequency characteristic reference line and the low boost (low frequency boosting) frequency characteristic reference line, which are adjusted by a user using the adjustment means, are memorized simultaneously with the input audio signal analysis and memory means; and further an automatic adjustment means for inclinations of the high boost (high frequency boosting) and low boost (low frequency boosting) frequency characteristic reference lines, wherein the automatic adjustment means analyzes the input audio signal, and selects corresponding input audio situation from the memory means for input audio situation and inclinations of high boost (high frequency boosting) and low boost (low frequency boosting) frequency characteristic reference lines, and further determines inclinations of the high boost (high frequency boosting) and low boost (low frequency boosting) frequency characteristic reference lines without any user adjustment. In this way, optimized inclination information of high boost (high frequency boosting) and low boost (low frequency boosting) frequency characteristic reference lines is automatically called to arrange hearing status corresponding to input audio.

The present invention is further provided with: a memory means for input audio situation and rotation center position of high boost (high frequency boosting) and low boost (low frequency boosting) frequency characteristic reference lines to memorize rotation center position which is simultaneously adjusted with inclinations of the high boost (high frequency boosting) frequency characteristic reference line and the low boost (low frequency boosting) frequency characteristic reference line; and an automatic adjustment means for rotation center position and inclinations of the high boost (high frequency boosting) and low boost (low frequency boosting) frequency characteristic reference lines, wherein the automatic adjustment means analyzes input audio signal, and selects corresponding input audio situation from the memory means for input audio situation and rotation center position and inclinations of high boost (high frequency boosting) and low boost (low frequency boosting) frequency characteristic reference lines, and further determines rotation center position and inclinations of the high boost (high frequency boosting) and low boost (low frequency boosting) frequency characteristic reference lines without any user adjustment.

The present invention is further provided with: an input audio signal analysis and memory means, whereby the input audio signal is analyzed and the input audio situation is memorized; a memory means for input audio situation and high boost (high frequency boosting) and low boost (low frequency boosting) coefficients to memorize high boost (high frequency boosting) coefficient and low boost (low frequency boosting) coefficient, which are adjusted by a user using the adjustment means, simultaneously with the input audio signal analysis and memory means; and an automatic adjustment means for high boost (high frequency boosting) and low boost (low frequency boosting) coefficients, whereby an input audio signal is analyzed, and a corresponding input audio situation is selected from the memory means for input audio situation and high boost (high frequency boosting) and low boost (low frequency boosting) coefficients, and the high boost (high frequency boosting) and low boost (low frequency boosting) coefficients are determined without any adjustment by a user. The analysis means to analyze the input audio signal is a frequency analysis means.

The present invention is provided with: in order for gain control according to frequency of input audio signal, a high boost (high frequency boosting) frequency characteristic reference line to enhance high frequency range and a low boost (low frequency boosting) frequency characteristic reference line to enhance low frequency range; a high boost (high frequency boosting) audio signal processing and generating means, whereby the input audio signal is dual distributed, one of the dual distributed signal refers to the high boost (high frequency boosting) frequency characteristic reference line, controls gain according to frequency, and enhances high frequency range; a low boost (low frequency boosting) audio signal processing and generating means, wherein the high boost (high frequency boosting) audio signal, generated by the aforementioned audio signal processing and generating means, and the other half of the dual distributed input audio signals is gain controlled according to frequency range, and low frequency range is enhanced referring to the aforementioned low boost (low frequency boosting) frequency characteristic reference line, wherein the low boost (low frequency boosting) audio signal generated by the low boost (low frequency boosting) audio signal processing and generating means and the aforementioned high boost (high frequency boosting) audio signal generated by the high boost (high frequency boosting) audio signal processing and generating means are generated; a high boost (high frequency boosting) audio signal coefficient-multiplying means, whereby coefficient-multiplying is carried out to adjust a ratio to synthesize two memorized audio signals with the high boost (high frequency boosting) audio signal; a low boost (low frequency boosting) audio signal coefficient-multiplying means, whereby coefficient-multiplying is carried out to adjust a ratio to synthesize two memorized audio signals with the low boost (low frequency boosting) audio signal; and a synthesized audio signal output means, whereby two audio signals generated by the high boost (high frequency boosting) audio signal coefficient-multiplying means and the low boost (low frequency boosting) acoustic coefficient-multiplying means are synthesized to be used as an audio output.

The high boost (high frequency boosting) frequency characteristic reference line and the low boost (low frequency boosting) frequency characteristic reference line are provided with: an adjustment means for inclination of high boost (high frequency boosting) frequency characteristic reference line, which adjusts inclination using a memorized frequency as a rotation center; an adjustment means for inclination of low boost (low frequency boosting) frequency characteristic reference line, which adjusts inclination using a memorized frequency as a rotation center; a high boost (high frequency boosting) center position adjustment means, which adjusts center position using a memorized frequency of the high boost (high frequency boosting) frequency characteristic reference line as a rotation center; and a low boost (low frequency boosting) center position adjustment means, which adjusts center position using a memorized frequency of the low boost (low frequency boosting) frequency characteristic reference line as a rotation center.

Further, it becomes possible to generate continuous audio signal corresponding to a user's hearing, his/her sound environment, and so on by providing the present invention with at least one adjustment means selected from the followings: a high/low boost (high/low frequency boosting) rotation center position adjustment means; a high boost (high frequency boosting) coefficient input adjustment means which adjusts coefficient, to be coefficient-multiplied on the high boost (high frequency boosting) audio signal; or a low boost (low frequency boosting) coefficient input adjustment means which adjusts coefficient, to be coefficient-multiplied on the low boost (low frequency boosting) audio signal.

The high boost (high frequency boosting) frequency characteristic reference line and the low boost (low frequency boosting) frequency characteristic reference line are adjusted independently from each other. The frequency range of a rotation center of the high boost (high frequency boosting) frequency characteristic reference line is between 1000 Hz and 8000 Hz, and the frequency range of a rotation center of the low boost (low frequency boosting) frequency characteristic reference line is between 400 Hz and 1000 Hz.

The frequency characteristic reference line can be single. In that case, the present invention is provided with: a frequency characteristic reference line in order for gain control according to frequency of input audio signal; and an audio signal processing and generating means whereby the input audio signal is gain controlled according to frequency referring to the frequency characteristic reference lines.

The hearing optimization device and the hearing optimization method, whereby audio signal is generated and output by the audio signal processing and generating means, wherein the a frequency range of the reference rotation center is between 500 Hz and 2 kHz, are provided with: an inclination adjustment means for the frequency characteristic reference lines to adjust its inclinations using a reference frequency as a rotation center; and a rotation center position adjustment means which adjusts the rotation center position of the reference frequency.

Advantageous Effect of the Invention

As described hereinbefore, for hearing aids designed for hearing impaired persons the present invention enables hearing correction corresponding to hearing characteristic of each user without making any complicated adjustment, and moreover, hearing correction is possible with easy adjustment in various places of various sound environments. A user can make optimized hearing correction regardless of time and place because the present invention allows him/her to adjust it easily, independent of his/her hearing condition of the day, his/her location at the moment, etc., according to his/her own hearing perception that only he/she can understand exactly.

The present invention is also beneficial for a person with normal hearing by allowing him/her clear and comfortable conversation in noisy environment or similar situation—he/she makes optimized correction with easy adjustment on his/her mobile phone etc. according to the location when he/she talks over the phone in various sound environments where various background noises are present. Further, the present invention enables easy and continuous hearing optimization corresponding to various hearings, sound environments, and locations.

DESCRIPTION OF PREFERRED EMBODIMENTS

The drawings are described in greater detail below.

Figure 1:
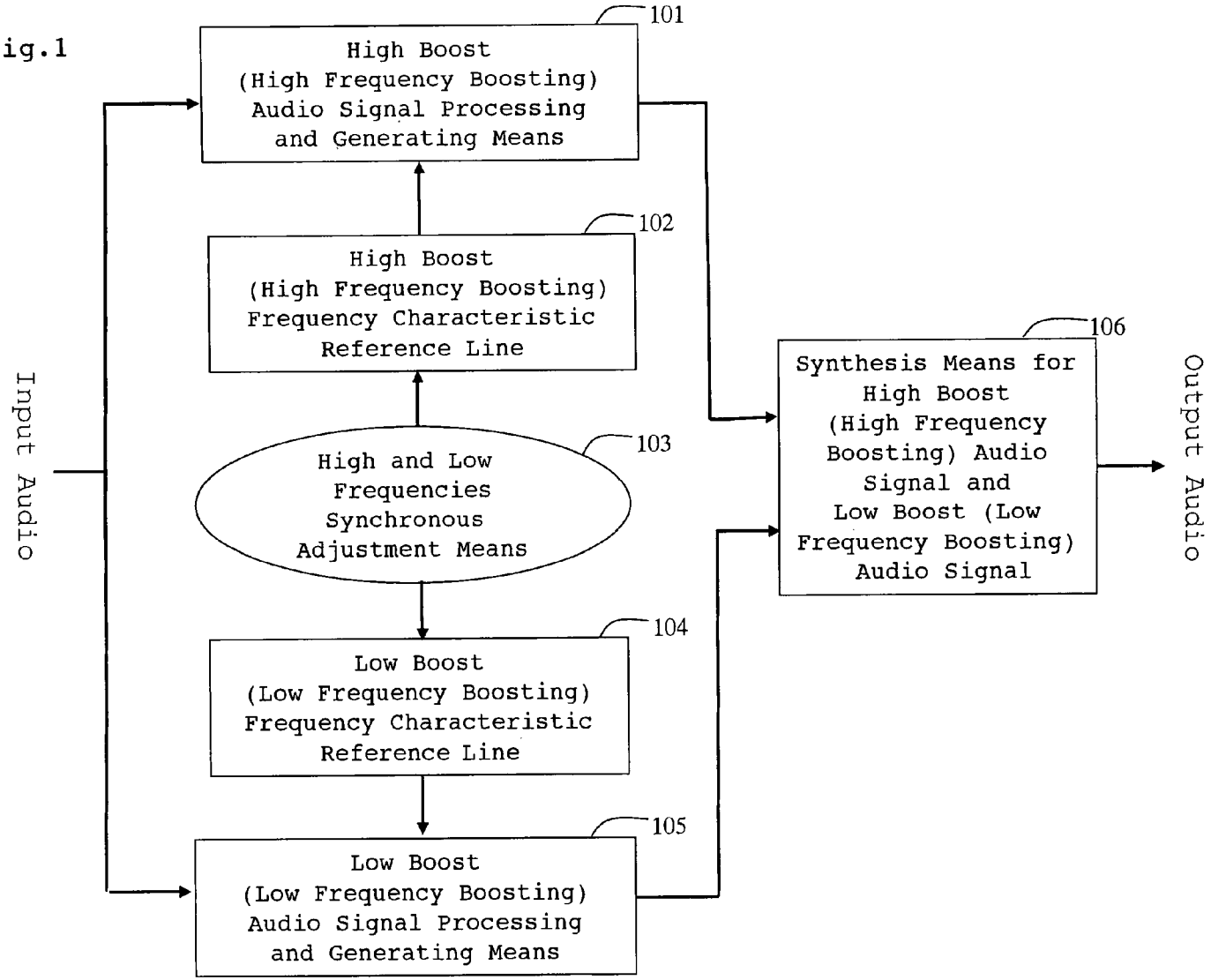
FIG. 1 is a schematic diagram showing an embodiment of the present invention.
Figure 2:
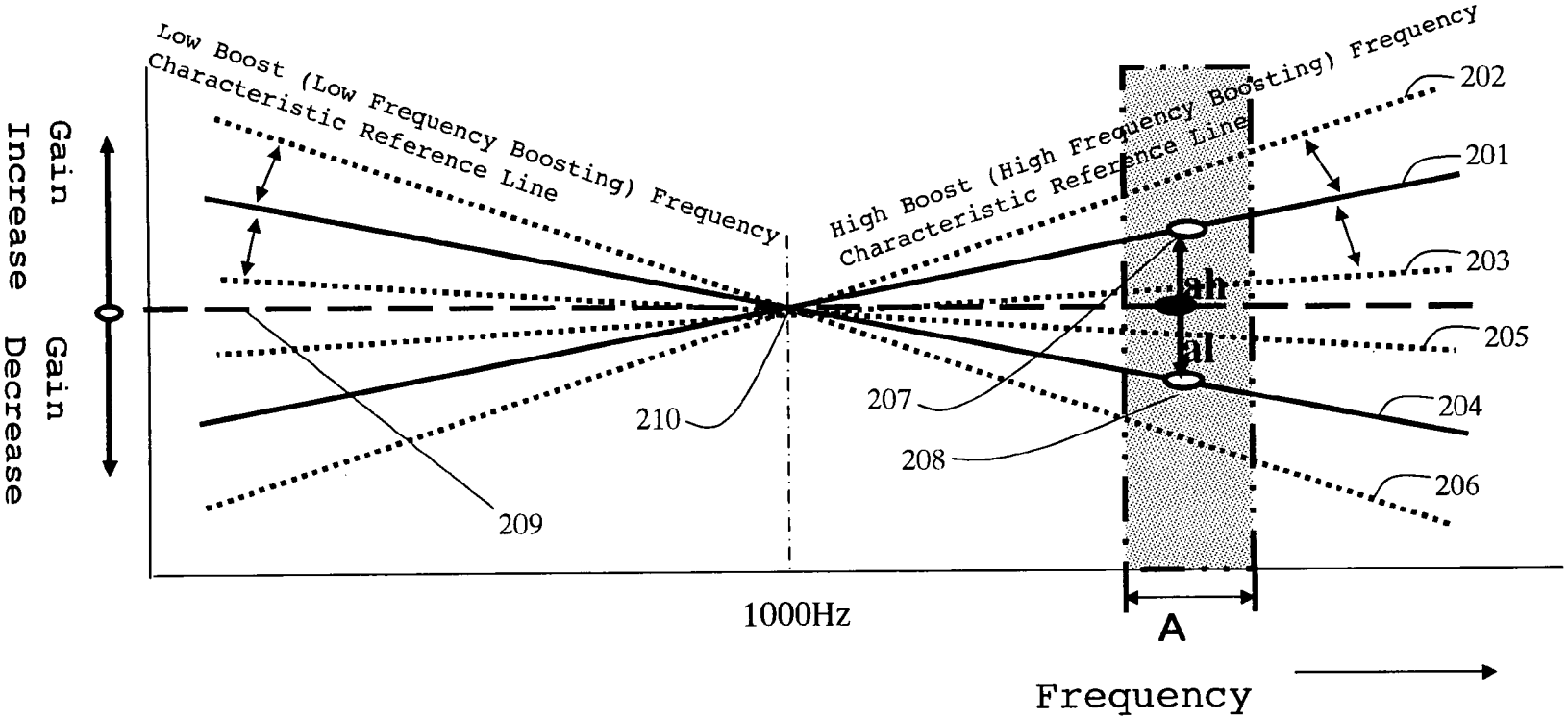
FIG. 2 is a graph showing adjustments of frequency characteristic reference lines, according to the present invention.

FIG. 1 is a schematic block diagram showing an embodiment of the present invention. FIG. 2 shows frequency characteristic reference lines which determine enhancement level of input audio signal according to frequency range.

In FIG. 1, the input audio signal is dual distributed to be used for audio signal generation. High frequency enhancing signal processing method is to refer to a high boost (high frequency boosting) frequency reference line 102, and, by a high boost (high frequency boosting) audio signal processing and generating means 101, generates high boost (high frequency boosting) audio signal. Low frequency enhancing signal processing method is to refer to a low boost (low frequency boosting) frequency reference line 104, and, by a low boost (low frequency boosting) audio signal processing and generating means 105, generates low boost (low frequency boosting) audio signal. Audio signal synthesizing method is to synthesize the generated high boost (high frequency boosting) audio signal and low boost (low frequency boosting) audio signal by a synthesis means 106 for high/low boost (high/low frequency boosting) audio signal to make an audio signal output.

Adjustment of frequency characteristic reference line is explained here in some details. By using a synchronous adjustment means 103 as shown in FIG. 1, a user synchronously adjusts the high boost (high frequency boosting) frequency characteristic reference line 102 and the low boost (low frequency boosting) frequency characteristic reference line 104.

In an adjustment method as shown in FIG. 2, preliminarily set high boost (high frequency boosting) frequency characteristic reference line and low boost (low frequency boosting) frequency characteristic reference line are numbered as 201 and 204 respectively.

In order to increase the inclination by the synchronous adjustment means 103 as shown in FIG. 1, a user gradually adjusts a high boost (high frequency boosting) frequency characteristic reference line 201 and a low boost (low frequency boosting) frequency characteristic reference line 204 until they reach 202 and 206 respectively, with crossing point 210 being user-adjusted at 1000 Hz as a center point, where each frequency characteristic reference line crosses.

In order to decrease the inclination by the synchronous adjustment means 103 as shown in FIG. 1, a user gradually adjusts the low boost (low frequency boosting) frequency characteristic reference line 201 and the low boost (low frequency boosting) frequency characteristic reference line 204 until they reach 203 and 205 respectively, with crossing point 210 being user-adjusted at 1000 Hz as a center point, where each frequency characteristic reference line crosses.

Figure 3:
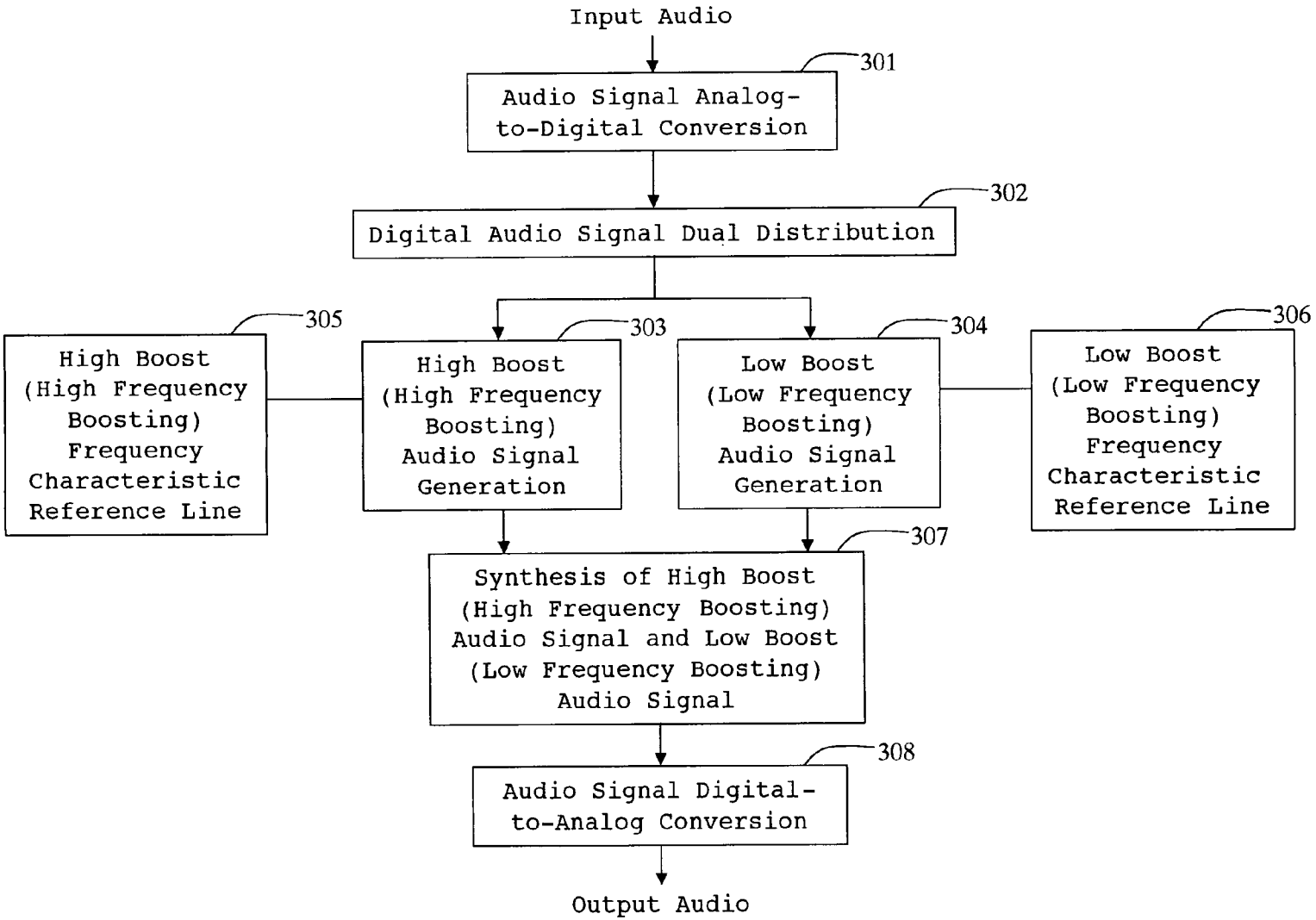
FIG. 3 is a flow diagram, according to the present invention.

Now going into details. FIG. 3 is a flow diagram of the foregoing description. First, audio signal input is analog-to-digital converted in 301 as needed, and then the digital audio signal is dual distributed in 302. One of the dual distributed digital audio signals is used for high boost (high frequency boosting) audio signal generation 303 in a way that high frequency is enhanced referring to high boost (high frequency boosting) frequency characteristic reference line 305. The other is used for low boost (low frequency boosting) audio signal generation 304 in a way that low frequency is enhanced referring to a low boost (low frequency boosting) frequency characteristic reference line 306.

A more detailed explanation is given by using FIG. 2. Gain is controlled independently according to frequency range, more specifically; gain of digital audio signal is increased or decreased according to the user-adjusted high boost (high frequency boosting) and low boost (low frequency boosting) frequency characteristic reference lines.

For the high boost (high frequency boosting) frequency characteristic reference line 201, which enhances high frequency, gain increase will enhance high frequency referring to the high boost (high frequency boosting) characteristic reference line 201 of each frequency range. For example, in frequency range A as displayed in FIG. 2, gain increase amount ah (between baseline 209 and point 207 on frequency characteristic reference line 201) is added to.

For the low boost (low frequency boosting) frequency characteristic reference line 204, which enhances low frequency, gain decrease will enhance low frequency referring to the low boost (low frequency boosting) characteristic reference line 204 of each frequency range. For example, in frequency range A as displayed in FIG. 2, gain decrease amount al (between baseline 209 and point 208 on frequency characteristic reference line 204) is decreased from.

The generated high frequency enhanced high boost (high frequency boosting) audio signal and low frequency enhanced low boost (low frequency boosting) audio signal are synthesized in 307, digital-to-analog converted in 308 as needed, and output as an audio signal.

Figure 4:
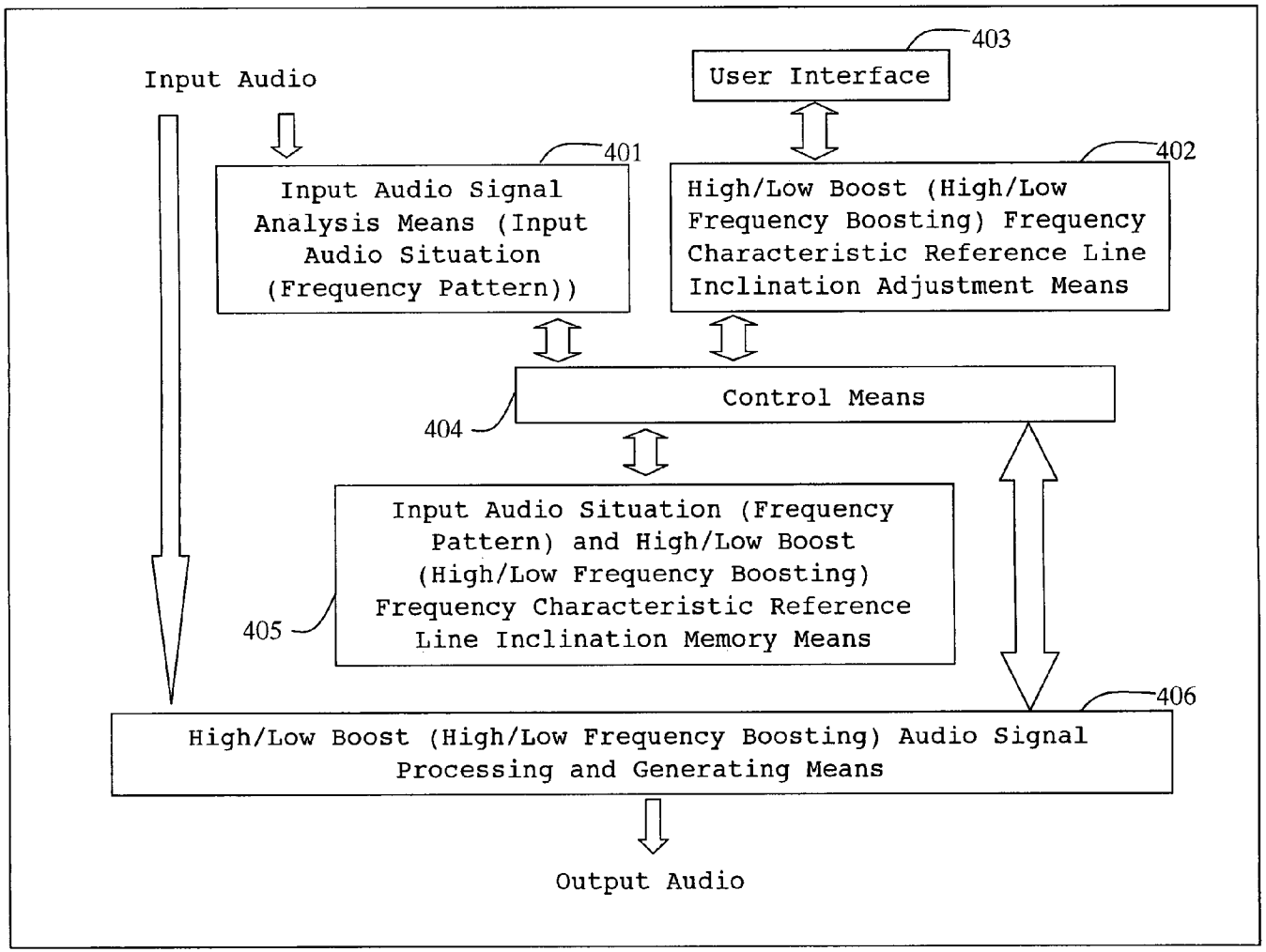
FIG. 4 is a block diagram showing adjustments corresponding to surrounding sound environments, according to the present invention.

Explained next is a method which requires no adjustment in such a case that surrounding sound environment situation (frequency pattern) is similar to that of preliminarily memorized one. FIG. 4 displays its schematic block diagram. The input audio signal is frequency analyzed by an input audio signal analysis means 401 to be made as an input audio situation (frequency pattern) and through a control means 404, is memorized in an input audio situation (frequency pattern) and high/low boost (high/low frequency boosting) frequency characteristic reference line inclination memory means 405. to memorize the input audio situation (frequency pattern), being frequency analyzed by the input audio signal analysis means 401, in input audio situation (frequency pattern) and the high/low frequency characteristic reference line inclination memory means 405 by the control means 404.

In the above mentioned process, audio signal output is made by a high/low boost (high/low frequency boosting) audio signal processing and generating means 406 as aforementioned and as in FIG. 3, according to inclinations of high boost (high frequency boosting) frequency characteristic reference line and low boost (low frequency boosting) frequency characteristic reference line.

While listening to the output audio, a user, through a user interface 403, then by high/low frequency characteristic reference line adjustment means 402, adjusts inclinations of the high boost (high frequency boosting) frequency characteristic reference line and the low boost (low frequency boosting) frequency characteristic reference line, then by the control means 404, together with an input audio situation (frequency pattern) which is frequency analyzed by the aforementioned input audio signal analysis means 401, to be memorized in input audio situation (frequency pattern) and the high/low frequency characteristic reference line inclination memory means 405.

Figure 5:
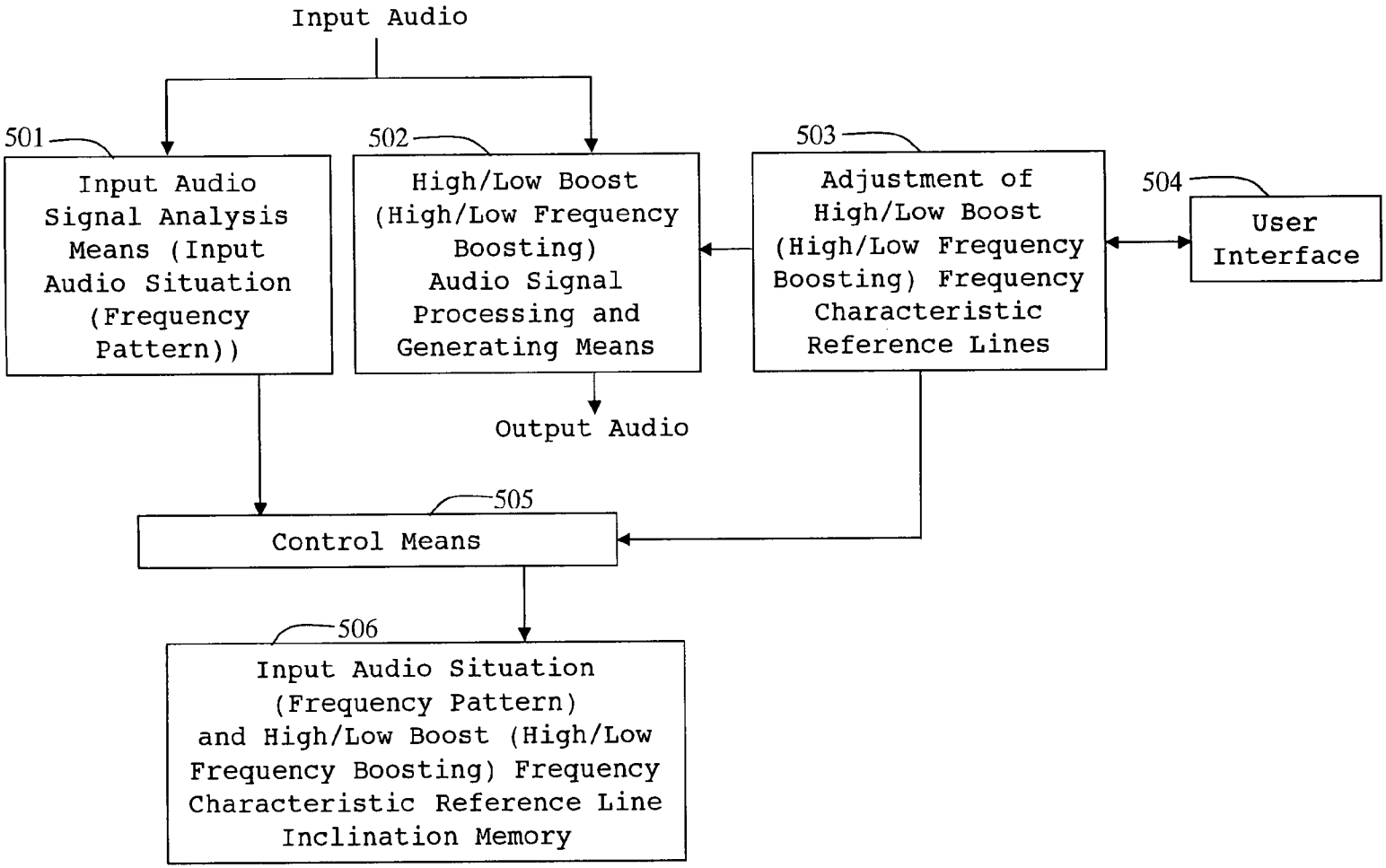
FIG. 5 is a flow diagram showing adjustments suited to user's specific sound environments, according to the present invention.

FIG. 5 shows a flow of memorization into input audio situation (frequency pattern) and high/low boost (high/low frequency boosting) frequency characteristic reference line inclination memory means. Input audio signal is frequency analyzed in an input audio signal analysis 501 to be output as an input audio situation (frequency pattern).

Output audio, being generated in a high/low boost (high/low frequency boosting) audio signal processing and generating means 502, is, through a user interface 504, then by a high/low boost (high/low frequency boosting) frequency characteristic reference line adjustment 503, adjusting inclinations of the high boost (high frequency boosting) frequency characteristic reference line and the low boost (low frequency boosting) frequency characteristic reference line, then by a control means 505, together with the aforementioned input audio situation (frequency pattern) 501, memorized in an input audio situation (frequency pattern) and high/low boost (high/low frequency boosting) frequency characteristic reference line inclination memory 506.

Described next is a method which makes suitable audio output adapted to the frequency pattern (surrounding sound environment situation) by calling inclinations of high/low boost (high/low frequency boosting) frequency characteristic reference lines from optimum input audio situation (frequency pattern) and high/low frequency characteristic reference line inclination memory means. Input audio signal is frequency analyzed by the input audio signal analysis means 401 in FIG. 4, to be made as an frequency pattern, and by the control means 404, examines whether a set of corresponding frequency pattern is being memorized in input audio situation (frequency pattern) and the high/low frequency characteristic reference line inclination memory means 405, and if there is one, calls and sends to the high/low boost (high/low frequency boosting) audio signal processing and generating means 406 to make an audio output.

This input audio situation (frequency pattern) and high/low frequency characteristic inclination memory, by being provided with a learning function, automatically adjusts to a user's specific sound environments as he/she continues to use the adjustment function.

However, an automatically called adjustment may not necessarily fit a user's hearing characteristic. In this case, adjustment is made through the user interface 403 and by the high/low boost (high/low frequency boosting) frequency characteristic reference line adjustment means 402. The control means 404 monitors whether there is such an adjustment and when there is one, without referring to input audio situation (frequency pattern) and the high/low boost (high/low frequency boosting) frequency characteristic reference line inclination memory means 405, inclinations of high boost (high frequency boosting) frequency characteristic reference line and low boost (low frequency boosting) frequency characteristic reference line, being adjusted by the high/low boost (high/low frequency boosting) frequency characteristic reference line inclination adjustment means 402, are forwarded to the high/low boost (high/low frequency boosting) audio signal processing and generating means 406 to be used as an audio signal output.

Figure 6:
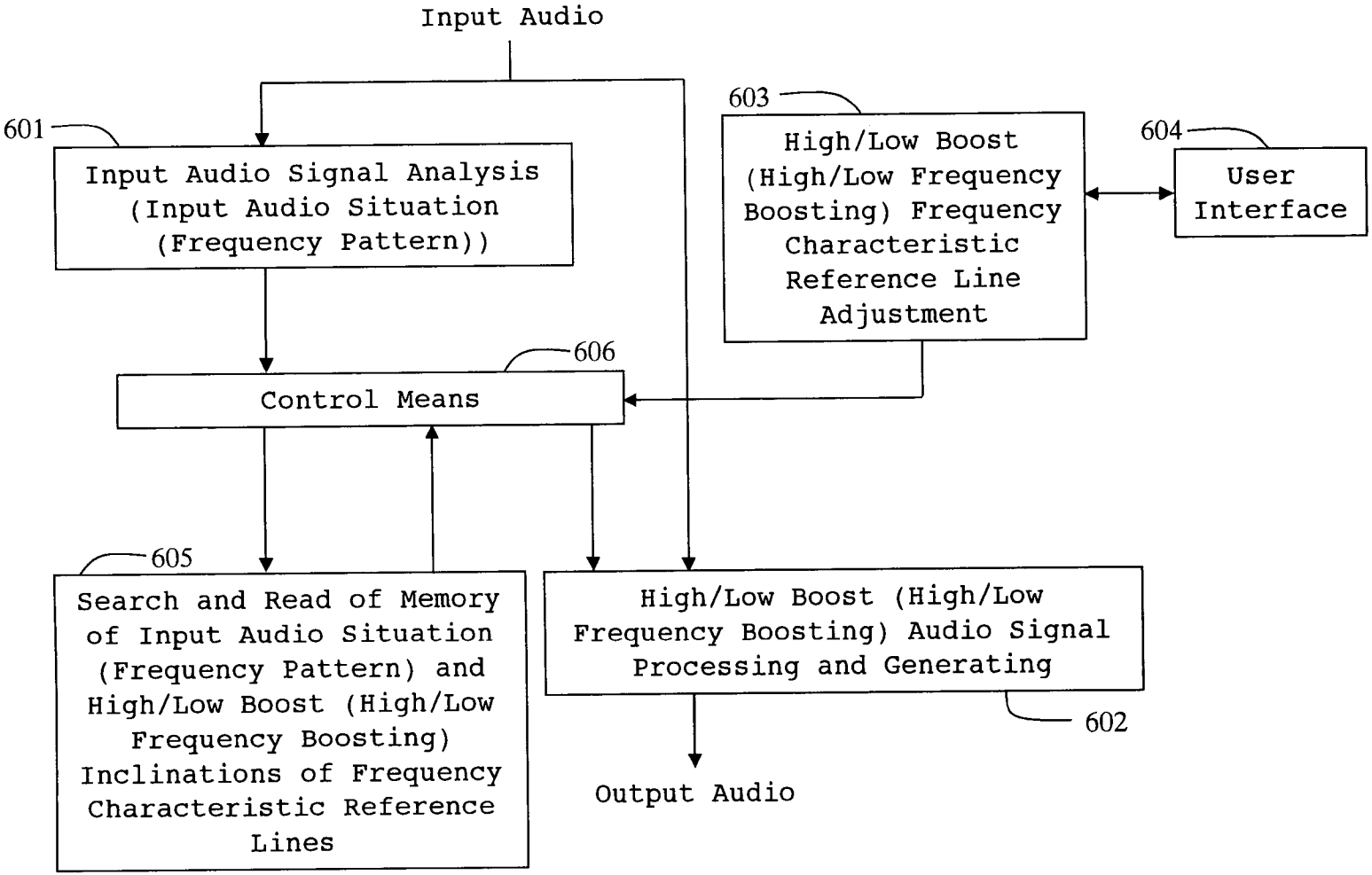
FIG. 6 is a memory reading flow diagram showing adjustments corresponding to surrounding sound environments, according to the present invention.

In a flow diagram as shown in FIG. 6, a user, through a user interface 604, monitors whether a high/low boost (high/low frequency boosting) frequency characteristic reference line adjustment 603 is being activated, and if it is, inclinations of a high boost (high frequency boosting) frequency characteristic reference line and a low boost (low frequency boosting) frequency characteristic reference line, being adjusted in the high/low boost (high/low frequency boosting) frequency characteristic line adjustment 603, are sent to a high/low boost (high/low frequency boosting) audio signal processing and generating 602 to be used as an audio signal output.

If a control means 606, in its monitoring, determines that the high/low boost (high/low frequency boosting) frequency characteristic reference line adjustment 603 is not being made, then input audio signal is frequency analyzed in 601, the input audio situation (frequency pattern) by the control means 606 and in 605, searches any corresponding data to this audio situation (frequency pattern), from user-adjusted memories of input audio situation (frequency pattern) and high/low boost (high/low frequency boosting) frequency characteristic reference line inclinations. Called inclinations, if any, of a high boost (high frequency boosting) frequency characteristic reference line and a low boost (low frequency boosting) frequency characteristic reference line are sent to the high/low boost (high/low frequency boosting) frequency audio signal processing and generating 602 to be used as an audio output.

In this way, adjusted inclinations of high boost (high frequency boosting) frequency characteristic reference line and low boost (low frequency boosting) frequency characteristic reference line for each frequency pattern are memorized, so that if an input audio is similar to any of the preliminarily memorized surrounding sound environment situation (frequency pattern), there is no need for adjustment. Inclinations of high boost (high frequency boosting) frequency characteristic reference line and low boost (low frequency boosting) frequency characteristic reference line, being memorized together with the corresponding surrounding sound environment situation (frequency pattern), are called to be used as an audio output by high/low boost (high/low frequency boosting) audio signal processing and generating means.

This embodiment requires a user to adjust according to the sound environment he/she is in. However, it is also possible to preliminarily measure and memorize inclinations of high boost (high frequency boosting) frequency characteristic reference line and low boost (low frequency boosting) frequency characteristic reference line by sound environments suited for average persons with normal hearing, and then, when needed, analyze an input audio signal to call inclinations of corresponding high boost (high frequency boosting) characteristic reference line and low boost (low frequency boosting) characteristic reference line.

Figure 7:
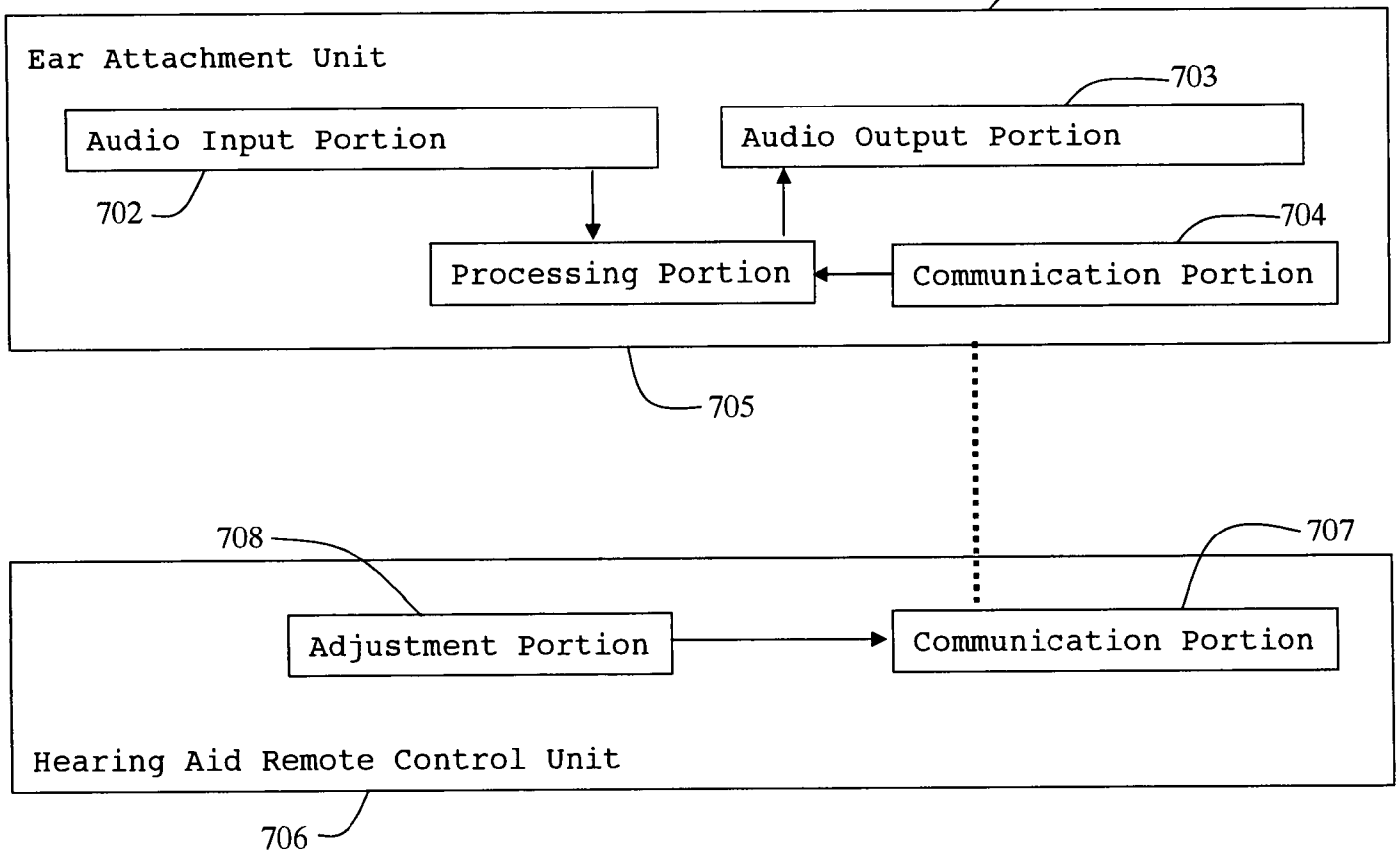
FIG. 7 is a schematic diagram showing an embodiment of a hearing aid, according to the present invention.

Explained next is an application of this embodiment to hearing aid. FIG. 7 is a configuration example. The hearing aid in this example is composed of an ear attachment unit 701 and a hearing aid remote control unit 706. The two units interface with each other by short range radio communication such as Bluetooth or ZigBee. Communication portions may be wired instead of wireless.

Figure 8:
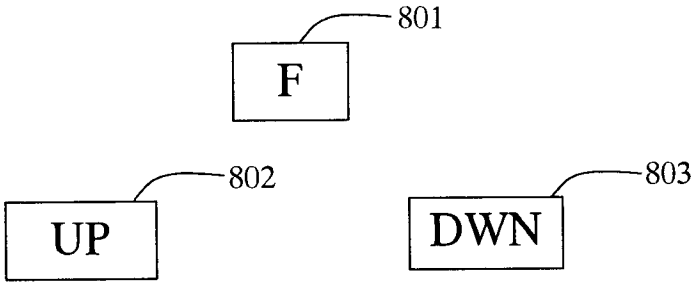
FIG. 8 is a schematic diagram showing an example of control buttons, according to the present invention.

The ear attachment unit 701 is provided with an audio signal input portion 702, a processing portion 705 wherein the aforementioned audio signal processing is performed, a communication portion 704 to radio communicate with the remote control unit, and an audio signal output portion 703. The hearing aid remote control Unit 706 is provided with an adjustment portion 708 to perform adjustment, and a communication portion 707 to communicate with the ear attachment unit. An example of the adjustment portion of a hearing aid is shown in FIG. 8, which is provided with a function button 801 displayed as F, an up button 802 displayed as UP, and a down button 803 displayed as DWN. Volume is adjustable by UP and DWN buttons.

Figure 9:
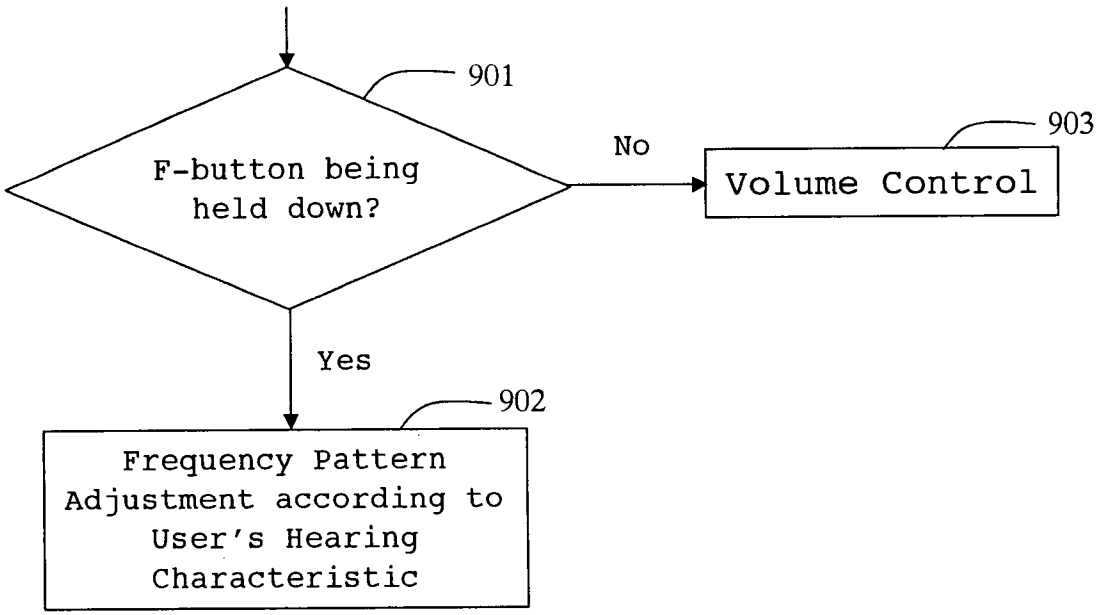
FIG. 9 is a flow diagram showing control button determination, according to the present invention.

The aforementioned frequency adjustment is performed in such ways that holding down the F button and pressing the UP button will increase inclination of frequency characteristic reference line, and holding down the F button and pressing the DWN will decrease inclination of frequency characteristic reference line. FIG. 9 displays a flow of how different functions of the UP and DWN buttons can be activated. Cognition whether the F button is being held down is made in 901: when it is being held down, the UP and DWN buttons will adjust inclinations of frequency characteristic reference lines to adjust frequency characteristic according to a user's hearing characteristic; and when it is not being held down, the UP and DWN buttons will adjust volume.

This embodiment provides the audio signal input portion within the ear attachment unit and the adjustment portion within the remote control unit of the hearing aid. However, other configurations of embodiment are possible. For example, all functions may be housed in the ear attachment unit. Any combination may be used unless it is against the spirit of the present invention.

Figure 10:
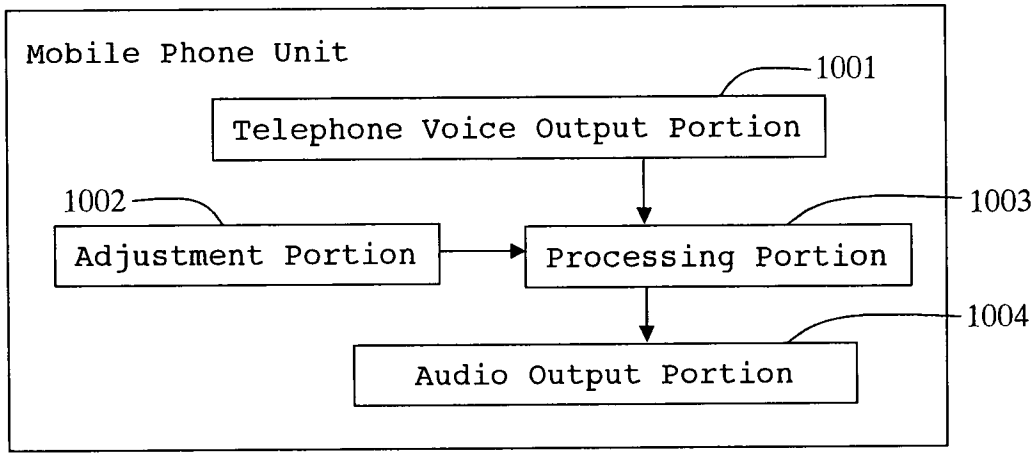
FIG. 10 is a schematic block diagram showing an embodiment of a mobile phone, according to the present invention.
Figure 11:
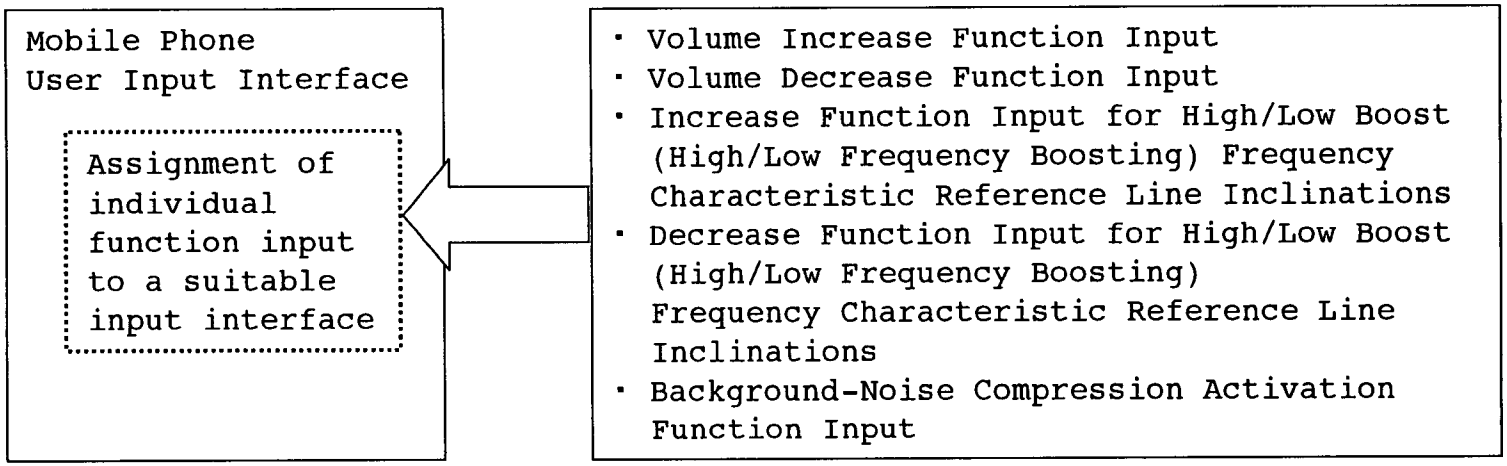
FIG. 11 is a schematic diagram showing control input of a mobile phone, according to the present invention.

Explained next is an embodiment for mobile phone, of which configuration is displayed in FIG. 10. An audio signal from telephone voice output unit 1001 is processed by the aforementioned method. An adjustment portion 1002 adjusts inclination of the frequency characteristic reference lines, adjusts frequency characteristic of a user's hearing characteristic, a processing portion 1003 processes audio signal, and an audio signal output portion 1004 outputs audio signal. Since mobile phones are preinstalled with user input interface, their existing control portions can be assigned with individual adjustment function. As shown in FIG. 11, the audio signal output is adjusted by volume increase/decrease and/or inclination increase/decrease of high/low boost (high/low frequency boosting) frequency characteristic reference lines. This embodiment is further provided with a noise compression function, which significantly decreases gain of a specific frequency range in order to make human voice frequency range more clearly hearable when the user is in a noisy environment.

Figure 12:
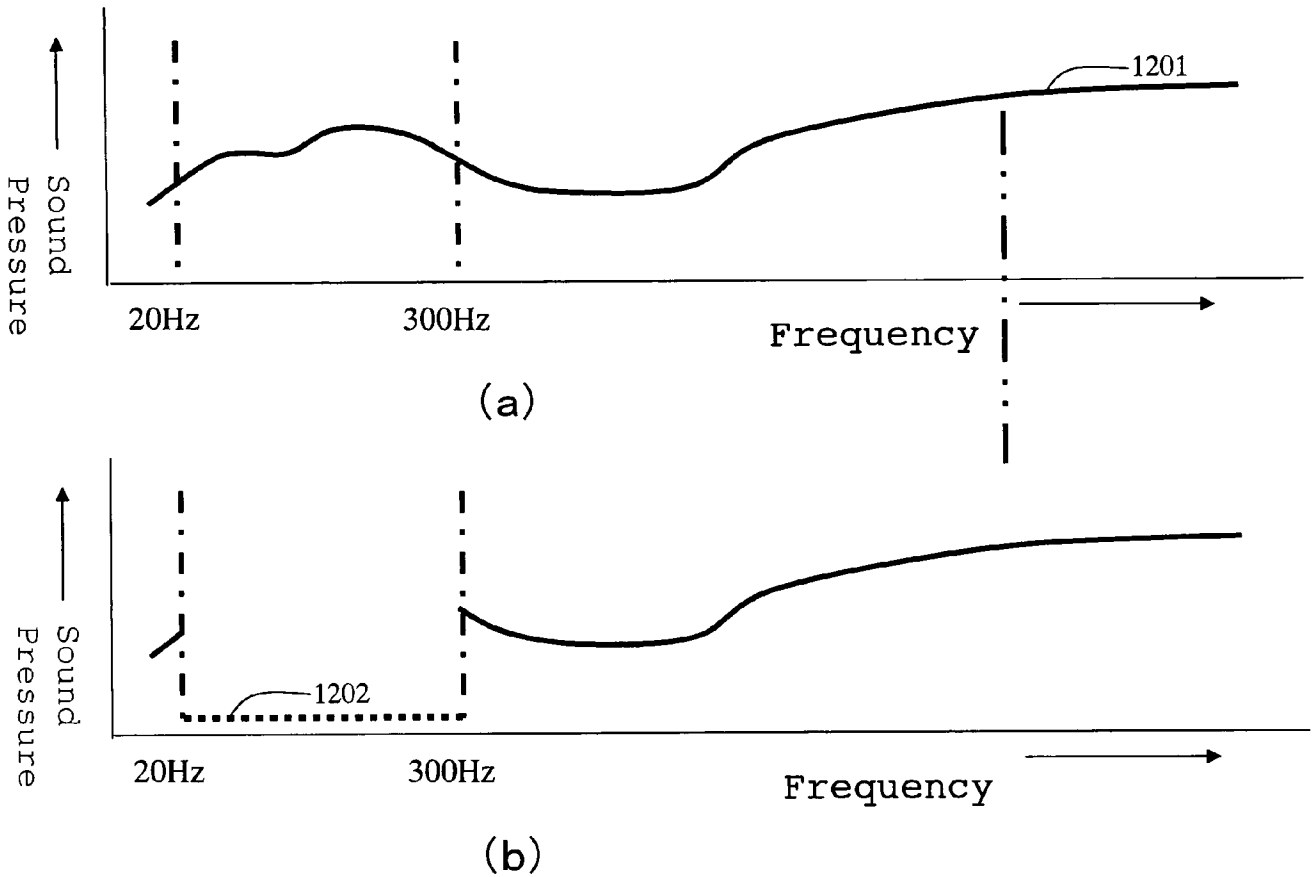
FIG. 12 illustrates graphs showing gain control corresponding to background noises, according to the present invention.

Explained next is a method for noise compression. When a user is on the mobile phone, some environmental background noises may mask the voice of a person who is on the other side of the phone. By compressing these noises the voice of the other party becomes more hearable. FIG. 12 shows about background noise compression, wherein graph (a) displays an audio situation 1201 before background noise compression, whereas graph (b) displays an audio situation after background noise compression, wherein gain of a frequency range between 20 Hz and 300 Hz is decreased to a level numbered as 1202, the frequency range being where human voice masking noises are on.

This embodiment activates background noise compression manually by a user, however, it is also available to have it done automatically, i.e., the specific frequency range (between 20 Hz and 300 Hz in this graph) is monitored to activate the compression function automatically when sound pressure exceeds a certain level.

This embodiment is about the background noise compression for a mobile phone. However, the embodiment is not limited to this particular application but is also applicable to a hearing aid. Further, this embodiment houses an adjustment portion and a processing portion within a mobile phone unit. However, the embodiment is not limited to this particular configuration but is also possible to house the adjustment portion and the processing portion within a headset, or within a set of a microphone and an earphone, for communication with a mobile phone. Or other telephone call applications than a mobile phone, such as a personal computer or the like being connected to an IP phone or other kinds of communication lines, are possible. Any combination may be used unless it is against the spirit of the present invention.

Figure 13:
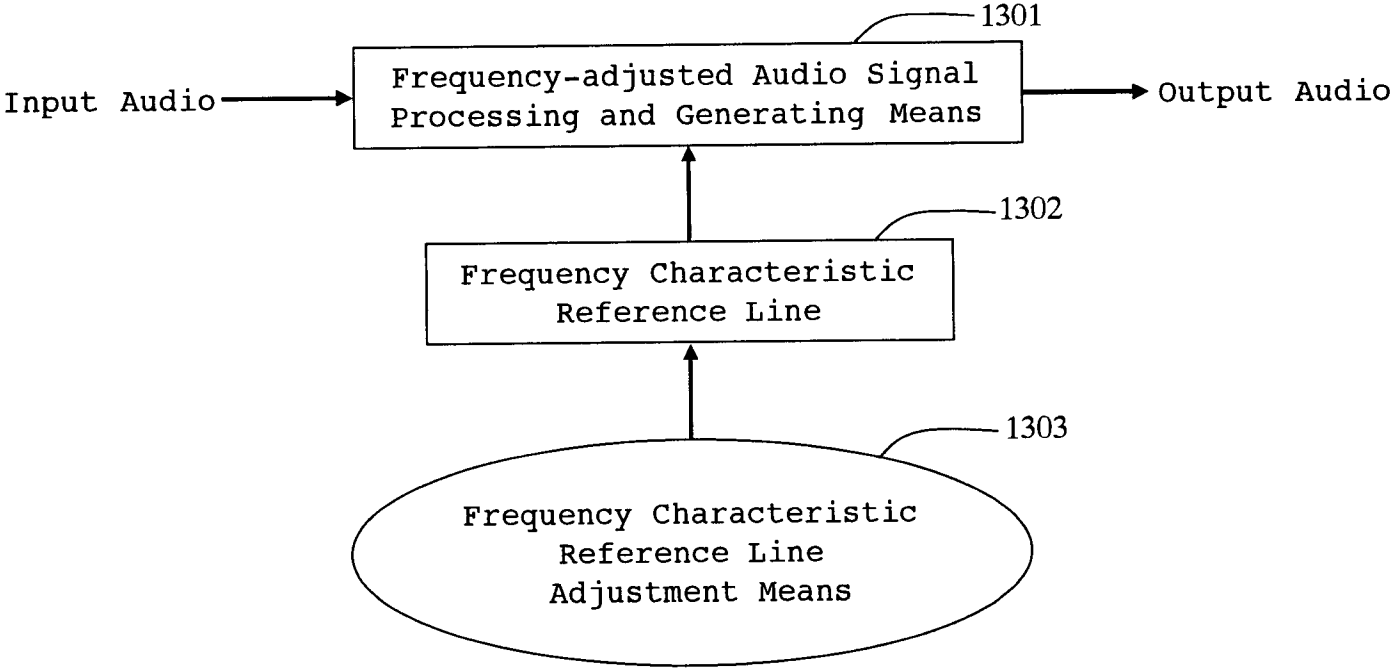
FIG. 13 is a schematic block diagram showing another embodiment of the present invention.
Figure 14:
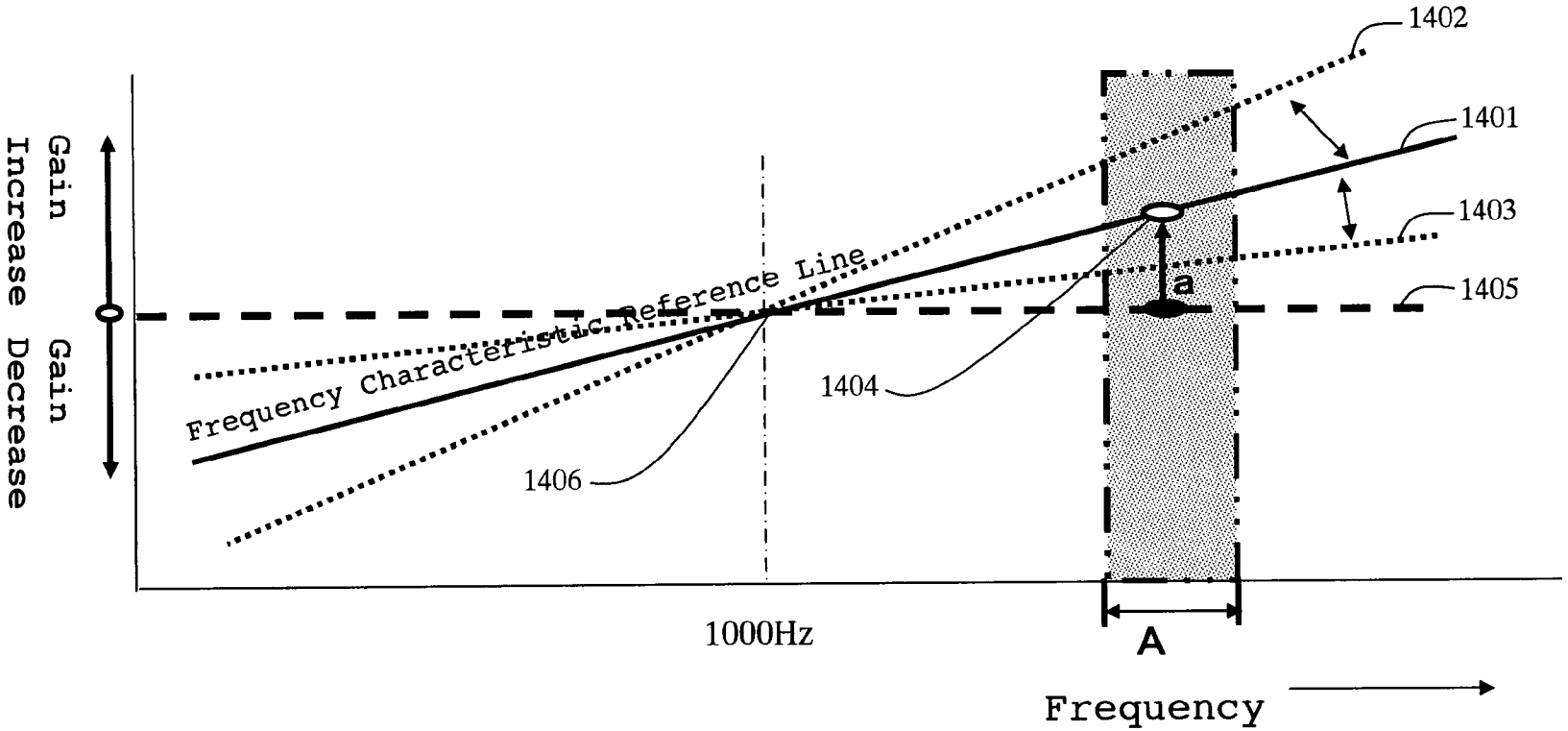
FIG. 14 is a graph showing frequency characteristic reference lines, according to the present invention.

Explained next is about another embodiment of the present invention. FIG. 13 is a schematic block diagram showing another embodiment of the present invention. FIG. 14 is a graph showing frequency characteristic reference lines in accordance which enhancement level of input audio signal is determined according to a frequency range. As shown in FIG. 13, signal processing method of input audio signal is to refer to a frequency characteristic reference line 1302, and then, by a frequency-adjusted audio signal processing and generating means 1301, to generate audio signal.

Now explaining about frequency characteristic reference line adjustment, a frequency characteristic reference line 1302 is adjustable by a frequency characteristic reference line adjustment means 1303 as shown in FIG. 13. As shown in FIG. 14, a preliminarily set frequency characteristic reference line is numbered as 1401. In order to increase the inclination by the synchronous adjustment means 1303 as shown in FIG. 13, a user gradually adjusts the frequency characteristic reference line until it reaches 1402, with the rotation center 1406 being user-adjusted at 1000 Hz.

Likewise, in order to decrease the inclination by the synchronous adjustment means 1303 as shown in FIG. 13, a user adjusts the frequency characteristic reference line until it reaches 1403, with the rotation center 1406 being user-adjusted at 1000 Hz. Going into details now with FIG. 15 which is a flow diagram of the above mentioned. Input audio is analog-to-digital converted as needed in 1501, and then the converted digital audio signal is processed in frequency characteristic adjustment audio signal generation 1502 by referring to a frequency characteristic reference line 1504.

A more detailed explanation is given by using FIG. 14. Gain is controlled independently according to frequency range. More specifically, gain of digital audio signal is increased or decreased according to the user-adjusted frequency characteristic reference lines. When a frequency characteristic reference line is being adjusted at 1401, gain is increased or decreased according to the frequency characteristic reference line 1401. For example, in frequency range A as displayed in FIG. 14, gain increase amount a (between baseline 1405 and point 1404 on frequency characteristic reference line 1401) is added to. The generated audio signal is then digital-to-analog converted in 1503 as shown in FIG. 15, as needed, to be output as an audio.

Figure 16:
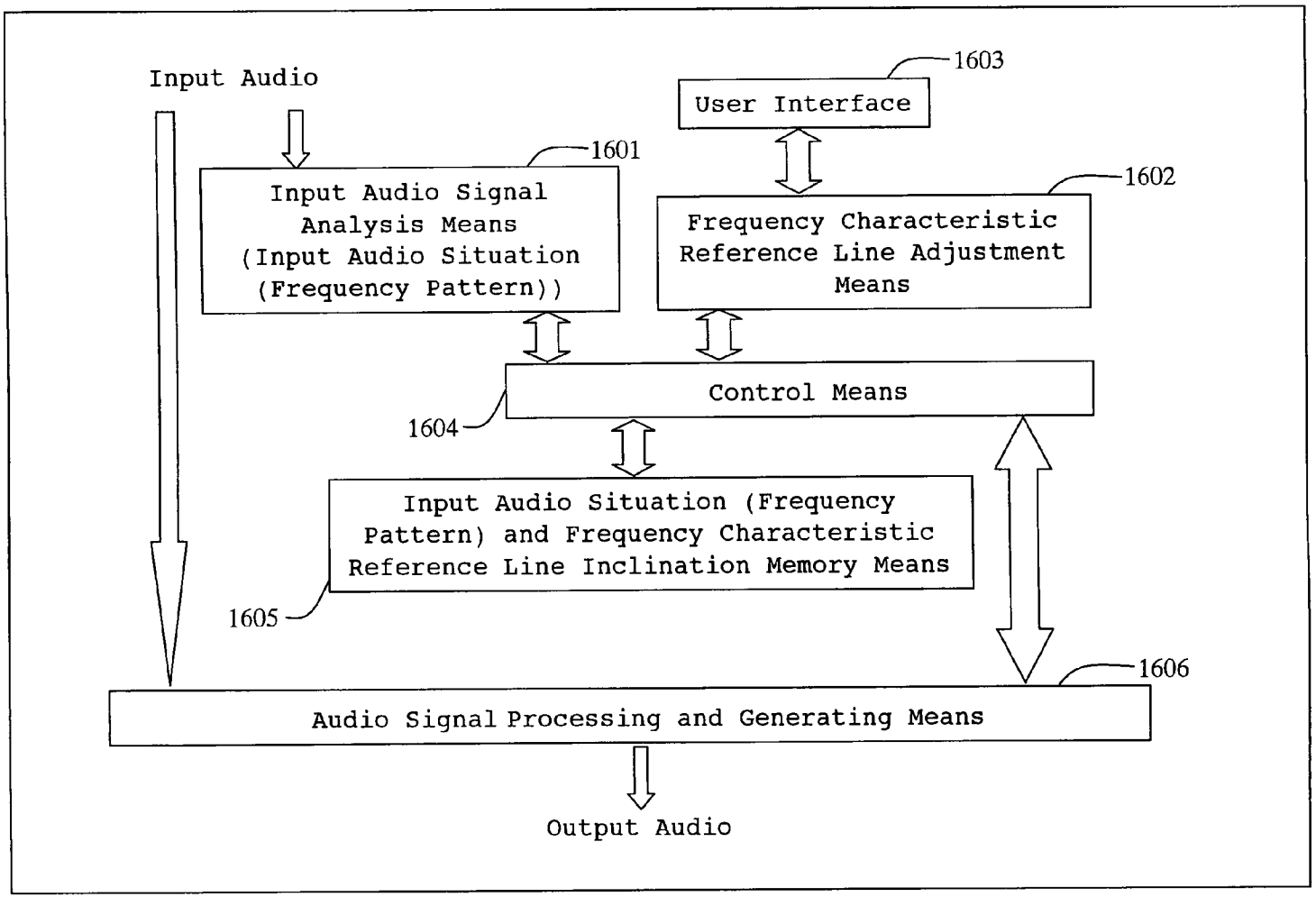
FIG. 16 is a block diagram showing automatic adjustments, according to the present invention.

Explained next is a method which requires no adjustment in such a case that a surrounding sound environment situation (frequency pattern) is similar to that of preliminarily memorized one. FIG. 16 displays its schematic block diagram. Here, input audio signal is frequency analyzed by an input audio signal analysis means 1601, and an input audio situation (frequency pattern) is, through a control means 1604, memorized in an input audio situation (frequency pattern) and frequency characteristic reference line inclination memory means 1605.

Figure 15:
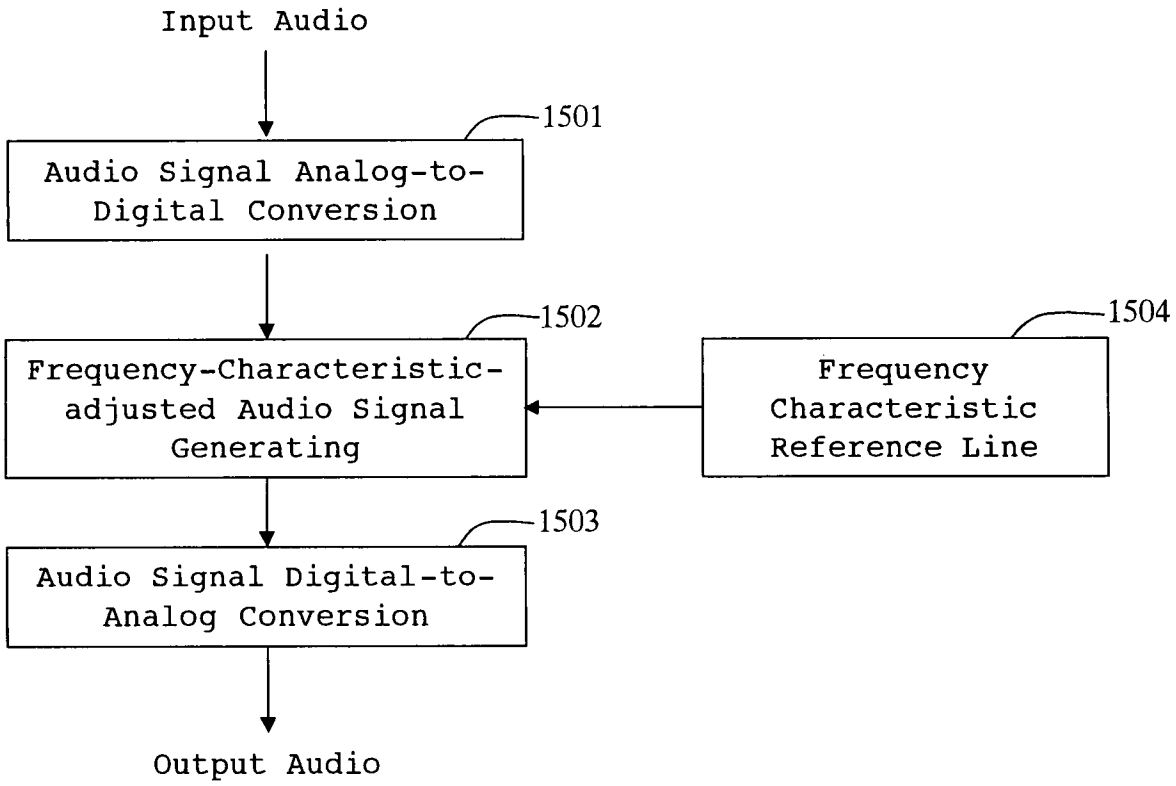
FIG. 15 is a flow diagram, according to the present invention.

In the above mentioned process, an audio output is made by audio signal generating means 1606 as aforementioned and as in FIG. 15, according to inclinations of frequency characteristic reference lines.

While listening to the output audio, a user is, through a user interface 1603, then by a frequency characteristic reference line adjustment means 1602, adjusts inclinations of the frequency characteristic reference lines, then by control means 1604, together with an input audio situation (frequency pattern) which is frequency analyzed by the aforementioned input audio signal analysis means 1601, to be memorized in input audio situation (frequency pattern) and frequency characteristic reference line inclination memory means 1605.

Figure 17:
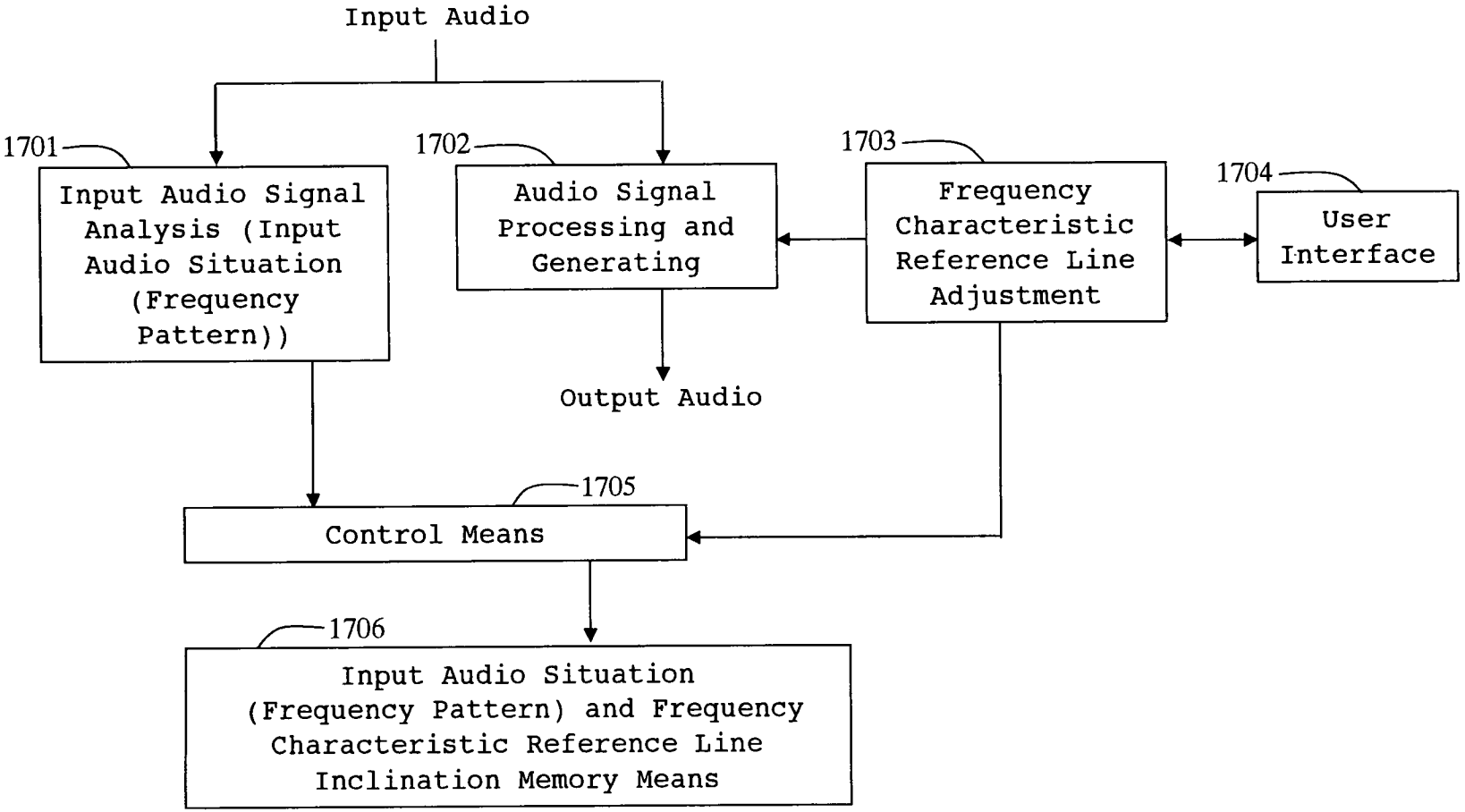
FIG. 17 is a block diagram showing adjustments by a user, according to the present invention.

FIG. 17 shows a flow of memorization into input audio situation (frequency pattern) and frequency characteristic reference line inclination memory means. Input audio signal is frequency analyzed in input audio signal analysis 1701 to be output as an input audio signal. Output audio, being generated in audio signal processing and generating 1702, is, through a user interface 1704, then by frequency characteristic reference line adjustment 1703, adjusting inclinations of the frequency characteristic reference lines, then by control means 1705, together with the aforementioned input audio situation (frequency pattern) 1701, memorized in an input audio situation (frequency pattern) and frequency characteristic reference line inclination memory means 1706.

Described next is a method which makes suitable audio signal output adapted to the surrounding sound environment situation (frequency pattern) by calling inclinations of frequency characteristic reference lines from optimum input audio situation (frequency pattern) and frequency characteristic reference line inclination memory means according to the surrounding sound environment situation.

Audio input is frequency analyzed by the input audio signal analysis means 1601 in FIG. 16, and an input audio situation (frequency pattern), by control means 1604, examines whether a set of corresponding input audio situation (frequency pattern) is being memorized in input audio situation (frequency pattern) and frequency characteristic reference line inclination memory means 1605, and if there is one, calls and sends to the audio signal processing and generating means 1606 to make an audio output.

This input audio situation (frequency pattern) and frequency characteristic inclination memory, by being provided with a learning function, automatically adjusts to a user's specific sound environment as he/she continues to use the adjustment function. However, an automatically called adjustment may not necessarily fit a user's hearing characteristic. In this case, adjustment is made through the user interface 1603 and by the frequency characteristic reference line adjustment means 1602. Control means 1604 monitors whether there is such an adjustment, and when there is one, without referring to an input audio situation (frequency pattern) and the frequency characteristic reference line inclination memory means 1605, inclinations of frequency characteristic reference lines, being adjusted by the frequency characteristic reference line inclination adjustment means 1602, are forwarded directly to the audio signal processing and generating means 1606 to be used as an audio output.

Figure 18:
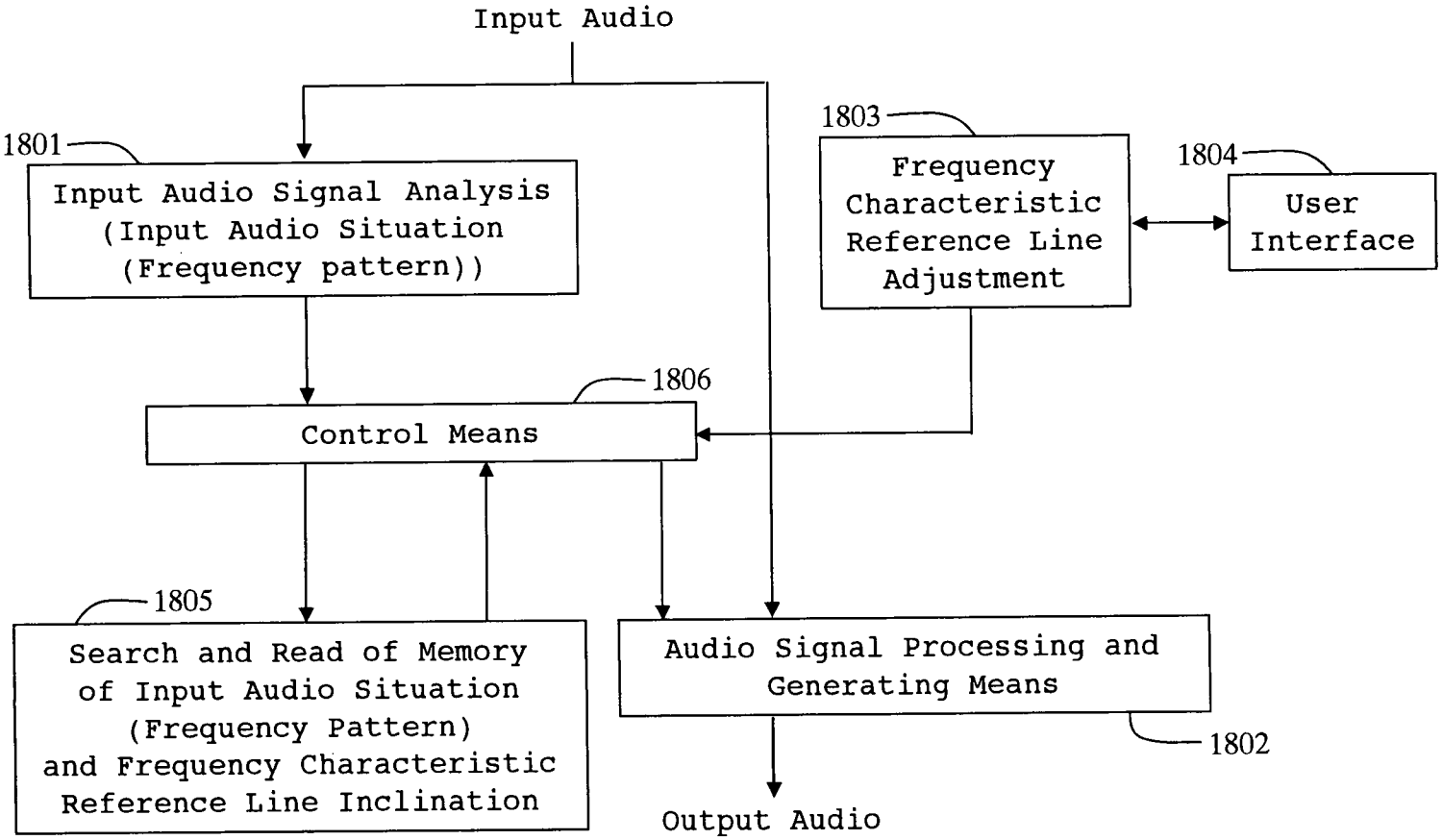
FIG. 18 is a block diagram showing learning ability, according to the present invention.

In a flow diagram as shown in FIG. 18, in a control means 1806, a user, through a user interface 1806, monitors whether frequency characteristic reference line adjustment 1803 is being activated, and if it is, inclinations of frequency characteristic reference lines, being adjusted in 1803, are sent to an audio signal processing and generating means 1802 to be used as an audio output.

If the control means 1806, in its monitoring, determines that the frequency characteristic reference line adjustment 1803 is not being made, then input audio signal is frequency analyzed in 1801 to be made as an input audio situation (frequency pattern) then by the control means 1806 and in 1805, searches any corresponding data to this input audio situation (frequency pattern), from memories of input audio signal and frequency characteristic reference line inclinations. Called inclinations, if any, frequency characteristic reference lines are sent to the audio signal processing and generating means 1802 to be used as an audio output.

In this way, adjusted inclinations of frequency characteristic reference lines for each surrounding sound environment situation (frequency pattern) are memorized, so that if an input audio is similar to any of the preliminarily memorized surrounding sound environment situation (frequency pattern), there is not any need for adjustment. Inclinations of frequency characteristic reference line, being memorized together with the corresponding surrounding sound environment situation (frequency pattern), are called to be used as an audio output by audio signal processing and generating means.

This embodiment requires a user to adjust according to sound environment. However, it is also possible to preliminarily measure and memorize inclinations of frequency characteristic reference lines suited for sound environment of average persons with normal hearing, and then, when needed, analyze input audio signals to call inclinations of corresponding frequency characteristic reference lines.

Figure 19:
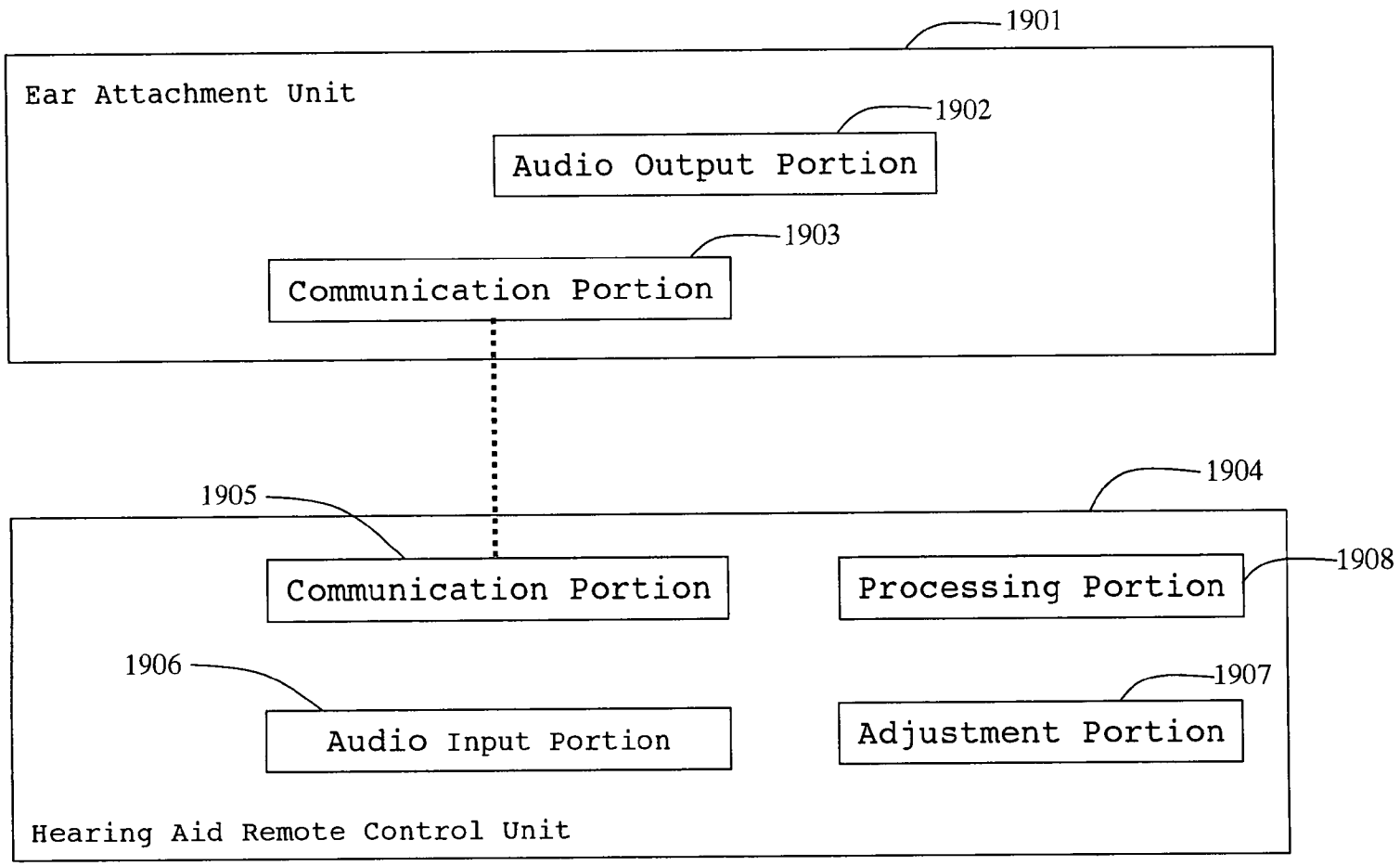
FIG. 19 is a schematic block diagram of another embodiment of construction of a hearing aid, according to the present invention.

Explained next is an application of this embodiment to hearing aid. FIG. 19 is a configuration example. The hearing aid in this example is composed of an ear attachment unit 1901 and a hearing aid remote control unit 1904. The two units interface with each other by short range radio communication such as Bluetooth or ZigBee. The ear attachment unit 1901 is provided with a communication portion 1903 to radio communicate with the remote control unit 1904, and an audio output portion 1902.

Figure 20:
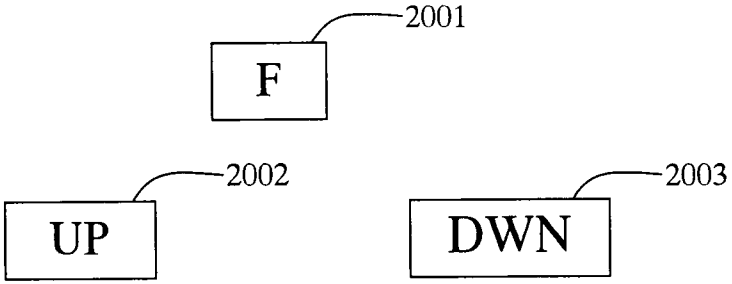
FIG. 20 is a schematic diagram showing an example of control buttons, according to the present invention.

The hearing aid remote control Unit 1904 is provided with an audio input portion 1906, an adjustment portion 1907 to perform adjustment, a processing portion 1908, and a communication portion 1905 to communicate with the ear attachment unit 1901. This embodiment provides the audio signal input portion within the ear attachment unit, however, it may be housed in the ear attachment unit. Any combination may be used unless it is against the spirit of the present invention. An example of the adjustment portion of a hearing aid is shown in FIG. 20, which is provided with a function button 2001 displayed as F, an up button 2002 displayed as UP, and a down button 2003 displayed as DWN. Volume is adjustable by UP and DWN buttons.

Figure 21:
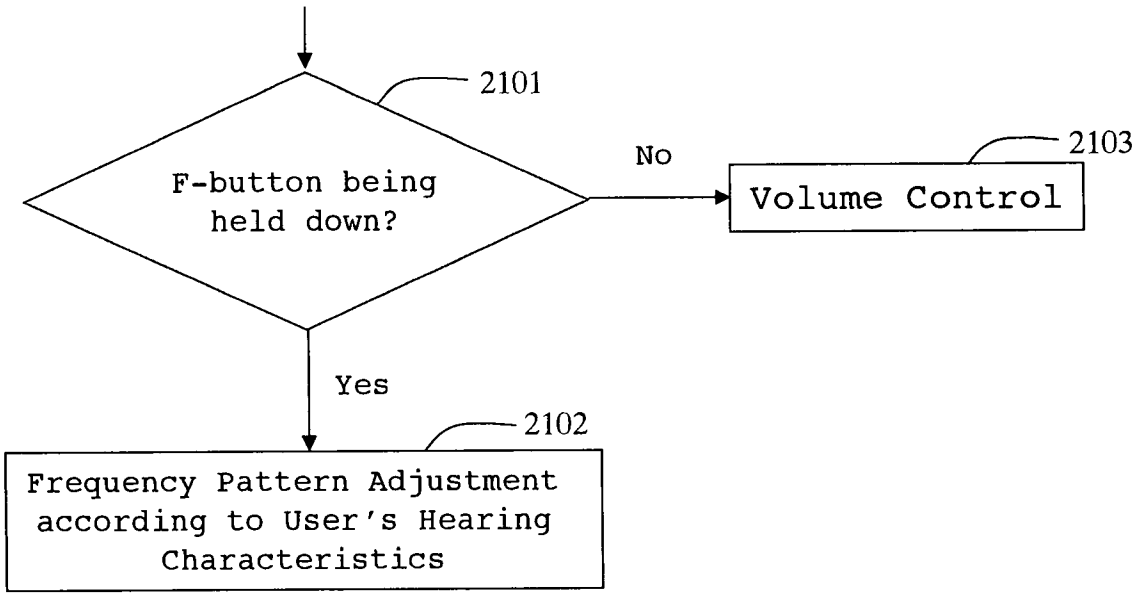
FIG. 21 is a flow diagram showing control button determination, according to the present invention.

The aforementioned frequency adjustment is performed in such ways that holding down the F button and pressing the UP button will increase inclination of frequency characteristic reference line, and holding down the F button and pressing the DWN will decrease inclination of frequency characteristic reference line. FIG. 21 displays a flow of how different functions of the UP and DWN buttons can be activated. Cognition whether the F button is being held down is made in 2101: when it is being held down, the UP and DWN buttons will adjust inclinations of frequency characteristic reference lines to adjust frequency characteristic according to a user's hearing characteristic; and when it is not being held down, the UP and DWN buttons will adjust volume.

Figure 22:
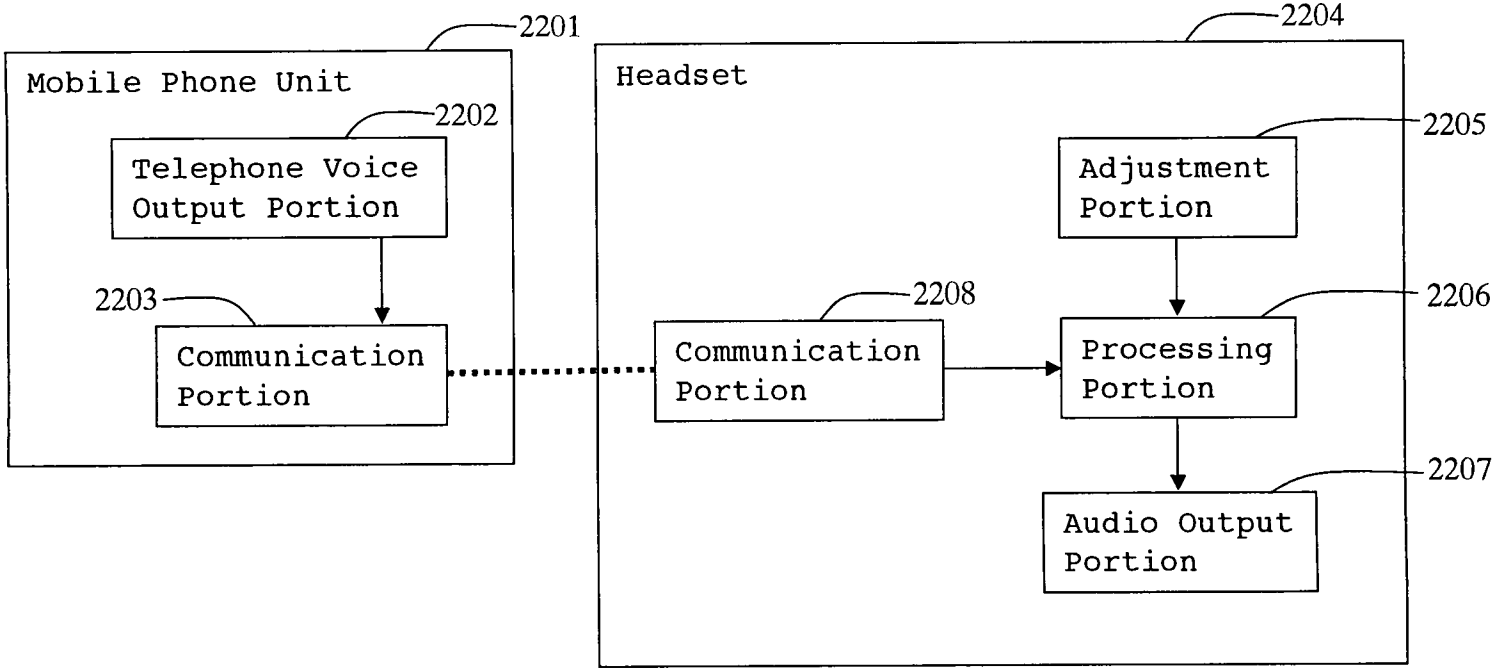
FIG. 22 is another embodiment of a mobile phone, according to the present invention.

FIG. 22 shows another embodiment of construction of a mobile phone, which comprises a mobile phone unit 2201 and a headset 2204. The mobile phone unit 2201 comprises a telephone voice output portion 2202, and a communication portion 2203 to communicate with the headset 2204. The headset 2204 comprises an audio signal input portion (not indicated in the figure), a communication portion 2208 which communicates with the mobile phone unit 2201, an adjustment portion 2205 which adjusts input frequency characteristic by adjusting inclination of frequency characteristic reference line, a processing portion 2206 which processes audio signal according to adjustment result from the processing adjustment portion, and an audio signal output portion 2207.

Figure 23:
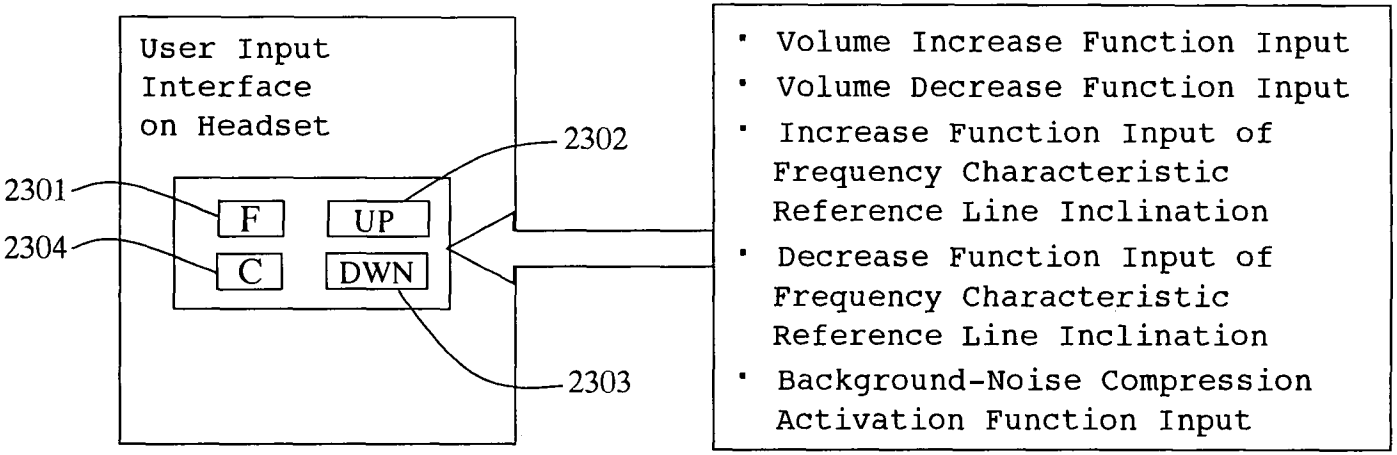
FIG. 23 is a schematic diagram showing control input, according to the present invention.

Explained next is further another embodiment of a mobile phone, as shown in FIG. 23, wherein an adjustment portion is housed within a headset unit, the adjustment portion being provided with a function button 2301 displayed as F, an up button 2302 displayed as UP, a down button 2303 displayed as DWN, and a noise compression button 2304 displayed as C. Volume is adjustable by UP and DWN buttons.

The aforementioned frequency adjustment is performed in such ways that holding down the F button and pressing the UP button will increase inclination of frequency characteristic reference line, holding down the F button and pressing the DWN will decrease inclination of frequency characteristic reference line, and pressing the C button will compress the frequency range of compress level of background noise.

Figure 24:
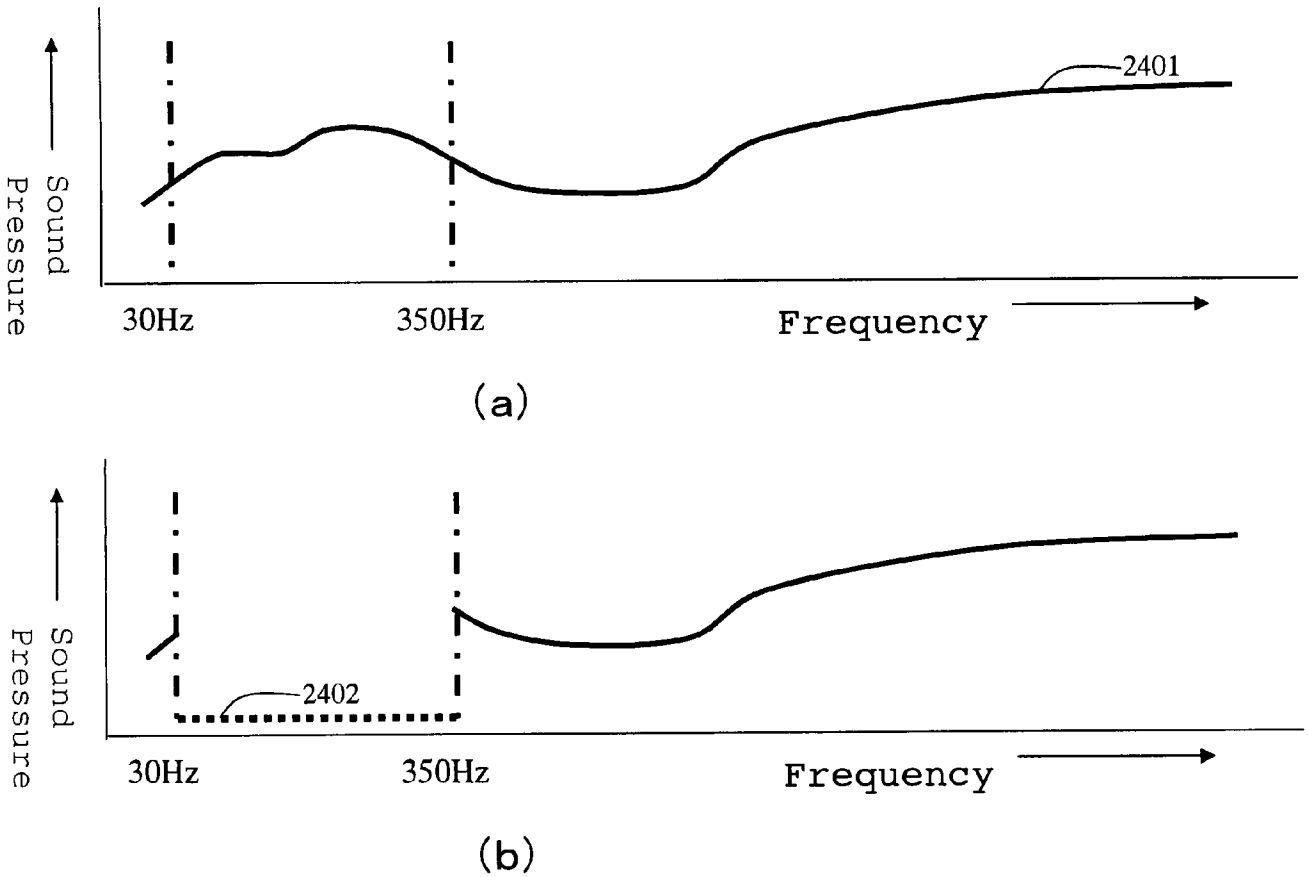
FIG. 24 illustrates graphs showing gain control corresponding to background noises, according to the present invention.

Explained next is a method for noise compression. When a user is on the mobile phone, some environmental background noises may mask the voice of a person who is on the other side of the phone. By compressing these noises the voice of the other party becomes more hearable. FIG. 24 shows about background noise compression, wherein graph (a) displays an audio situation 2401 before background noise compression, whereas graph (b) displays an audio situation after background noise compression, wherein gain of a frequency range between 30 Hz and 350 Hz is decreased to a level numbered as 2402, the frequency range being where human voice masking noises are on.

This embodiment activates background noise compression manually by a user, however, it is also available to have it done automatically, i.e., the specific frequency range (between 30 Hz and 350 Hz in this graph) is monitored to activate the compression function automatically when sound pressure exceeds a certain level.

In this embodiment, noise compression is applied to only audio signal output; however, it can also be applied to audio signal input. In this case, the voice of a user talking on the mobile phone can be transmitted to a person on the other side of the line with background noise in the voice frequency range being compressed.

This embodiment is about the background noise compression for a mobile phone. However, the embodiment is not limited to this particular application but is also applicable to a hearing aid. Further, this embodiment houses an adjustment portion and a processing portion within a mobile phone unit. However, the embodiment is not limited to this particular configuration but is also possible to house the adjustment portion and the processing portion within a headset, or a set of a microphone and an earphone, for communication with a mobile phone.

Or other telephone call applications than a mobile phone, such as a personal computer or the like being connected to an IP phone or other kinds of communication lines, are possible. Any combination may be used unless it is against the spirit of the present invention.

Figure 25:
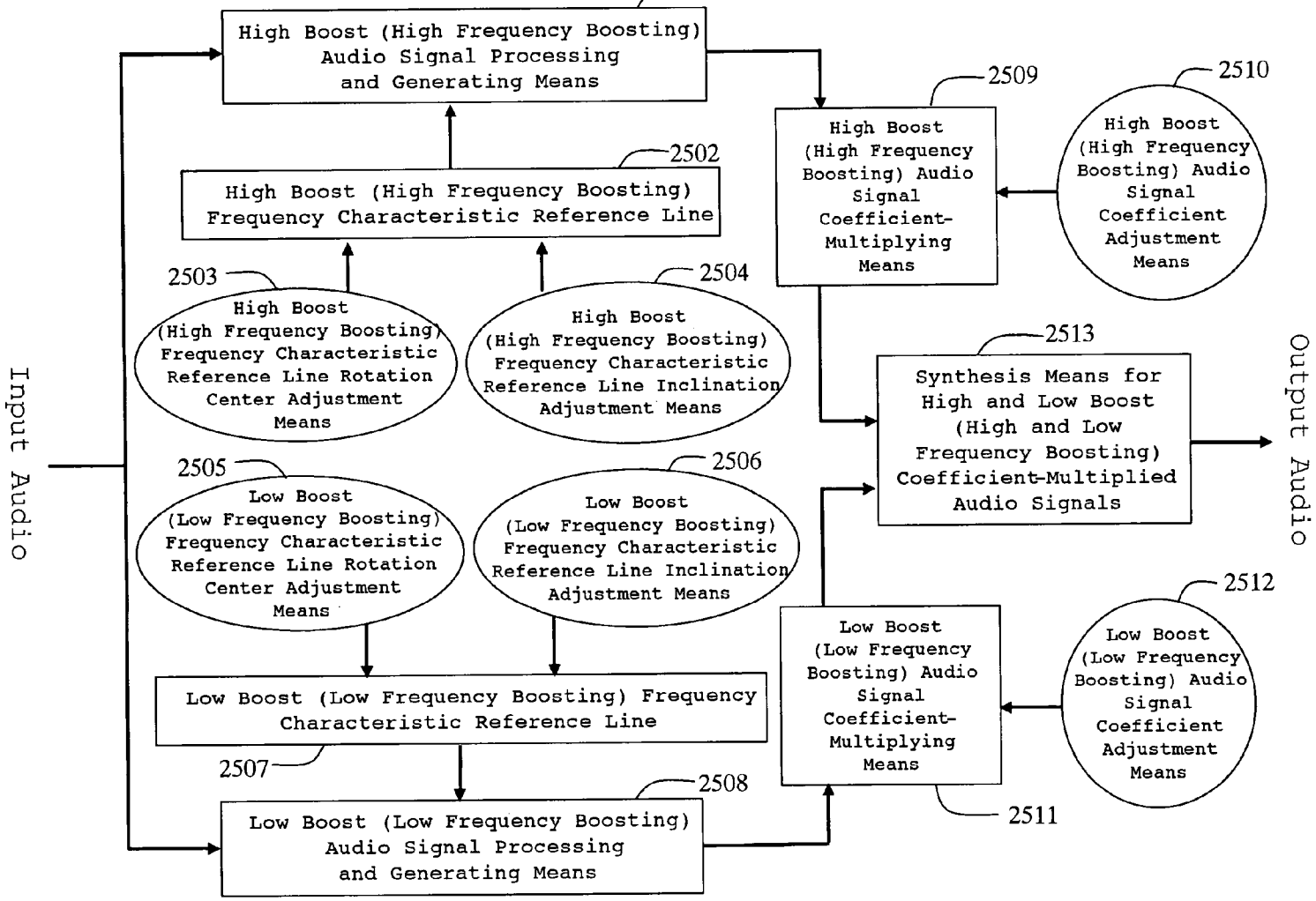
FIG. 25 is a schematic diagram showing an embodiment which has a plurality of adjustment mechanisms, according to the present invention.
Figure 26:
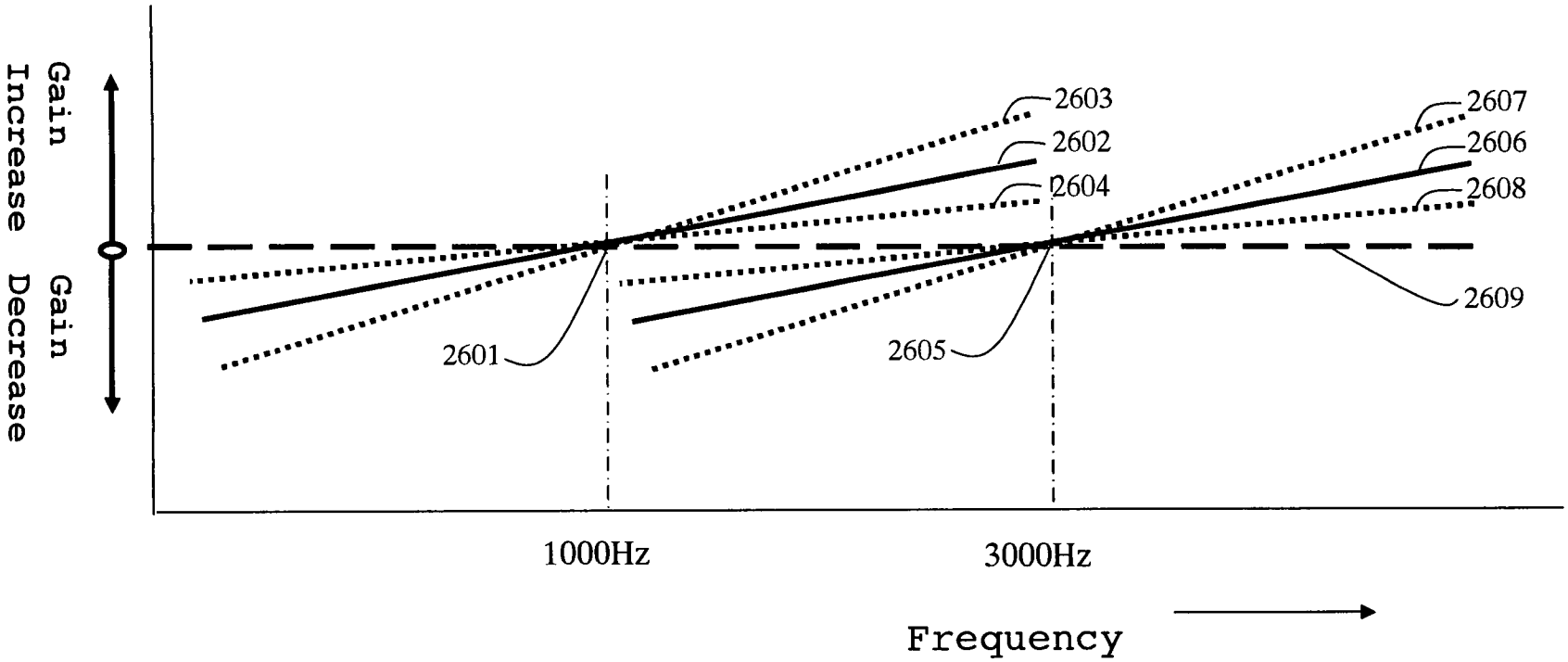
FIG. 26 is a graph showing adjustments of high boost (high frequency boosting) frequency characteristic reference lines, according to the present invention.
Figure 27:
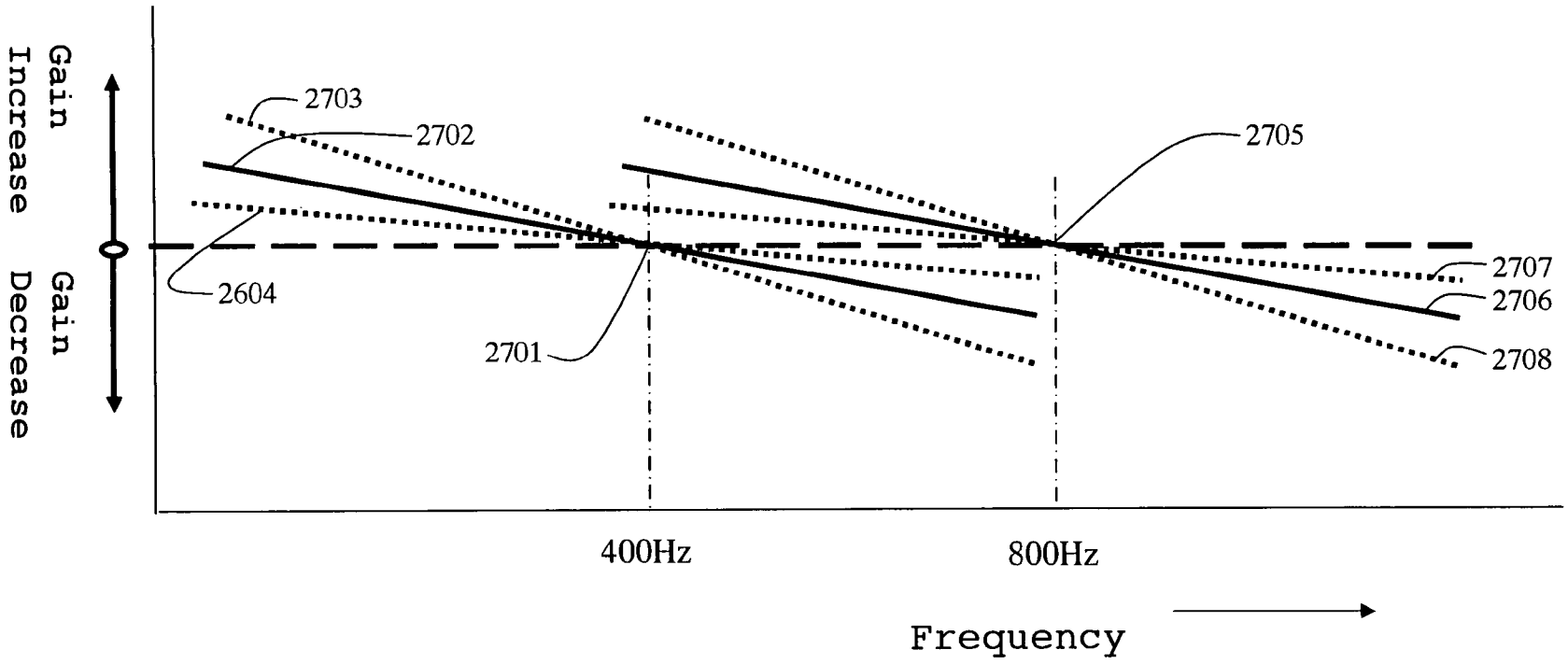
FIG. 27 is a graph showing adjustments of low boost (low frequency boosting) frequency characteristic reference lines, according to the present invention.

FIG. 25 is a schematic block diagram of further another embodiment of the present invention. FIG. 26 shows a high boost (high frequency boosting) frequency characteristic reference line, in accordance which enhancement level of input audio signal is determined to enhance a high frequency range. FIG. 27 shows a low boost (low frequency boosting) frequency characteristic reference line, in accordance which enhancement level of input audio signal is determined to enhance a low frequency range.

In FIG. 25, the input audio signal is dual distributed to be used for audio signal generation. High frequency enhancing signal processing method is to refer to a high boost (high frequency boosting) frequency reference line 2502, and, by a high boost (high frequency boosting) audio signal processing and generating means 2501, generate high boost (high frequency boosting) audio signal. Low frequency enhancing signal processing method is to refer to a low boost (low frequency boosting) frequency reference line 2507, and, by a low boost (low frequency boosting) audio signal processing and generating means 2508, generate low boost (low frequency boosting) audio signal.

The generated high boost (high frequency boosting) audio signal is, by referring to a high boost (high frequency boosting) audio signal coefficient-multiplying adjustment means 2510, coefficient-multiplied by a high boost (high frequency boosting) audio signal coefficient-multiplying means 2509. The coefficient may be any numeric value between 0.01 and 10.

Likewise, the generated low boost (low frequency boosting) audio signal is, by referring to a low boost (low frequency boosting) audio signal coefficient-multiplying adjustment means 2512, coefficient-multiplied by low boost (low frequency boosting) audio signal coefficient-multiplying means 2511. Likewise, the coefficient may be any numeric value between 0.01 and 10. These coefficient-multiplied audio signals are synthesized by a synthesis means 2513 for high and low boost (high and low frequency boosting) coefficient-multiplied audio signal to make an audio signal output.

Explained now is about adjustment of high boost (high frequency boosting) frequency characteristic reference lines. As shown in FIG. 25, a high boost (high frequency boosting) frequency characteristic reference line rotation center adjustment means 2503 adjusts rotation center of inclination, and a low boost (low frequency boosting) frequency characteristic reference line inclination adjustment means 2504 adjusts inclination.

FIG. 26 shows an example wherein a rotation center 2601 is set at 1000 Hz. Inclination of a user-adjusted high boost (high frequency boosting) frequency characteristic reference line 2602 may be adjusted to be as 2603 or 2604 by the inclination adjustment means. FIG. 26 also shows another example wherein a rotation center 2605 is set at 3000 Hz. Inclination of a user-adjusted high boost (high frequency boosting) frequency characteristic reference line 2606 may be adjusted to be as 2603 or 2604 by the inclination adjustment means.

The aforementioned high boost (high frequency boosting) frequency characteristic reference line inclination rotation center adjustment means is performed by the high boost (high frequency boosting) frequency characteristic reference line rotation center adjustment means 2503 as shown in FIG. 25, and high boost (high frequency boosting) frequency characteristic reference line inclination adjustment is performed by the high boost (high frequency boosting) frequency characteristic reference line inclination adjustment means 2504 also as shown in FIG. 25.

Explained now is about adjustment of low boost (low frequency boosting) frequency characteristic reference lines. As shown in FIG. 25, a low boost (low frequency boosting) frequency characteristic reference line rotation center adjustment means 2505 adjusts rotation center of inclination, and a low boost (low frequency boosting) frequency characteristic reference line inclination adjustment means 2506 adjusts inclination.

FIG. 27 shows an example wherein a rotation center 2701 is set at 400 Hz. Inclination of a user-adjusted low boost (low frequency boosting) frequency characteristic reference line 2702 may be adjusted to be as 2703 or 2704 by the inclination adjustment means. FIG. 27 also shows another example wherein a rotation center 2705 is set at 800 Hz. Inclination of a user-adjusted low boost (low frequency boosting) frequency characteristic reference line 2706 may be adjusted to be as 2707 or 2708 by the inclination adjustment means.

The aforementioned low boost (low frequency boosting) frequency characteristic reference line inclination rotation center adjustment means is performed by the low boost (low frequency boosting) frequency characteristic reference line rotation center adjustment means 2505 as shown in FIG. 25, and low boost (low frequency boosting) frequency characteristic reference line inclination adjustment is performed by the low boost (low frequency boosting) frequency characteristic reference line inclination adjustment means 2506 also as shown in FIG. 25.

Figure 28:
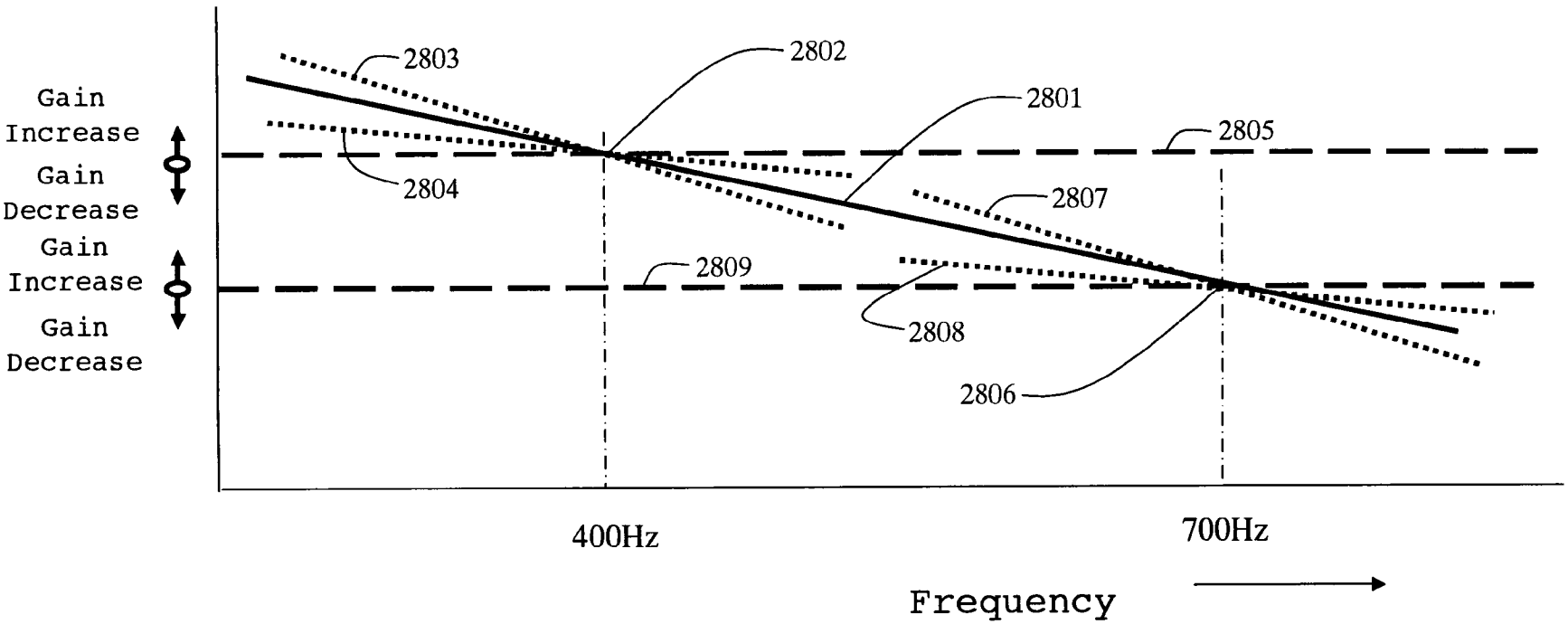
FIG. 28 is a graph showing other adjustments of low boost (low frequency boosting) frequency characteristic reference lines, according to the present invention.

This embodiment explains that a rotation center of frequency characteristic inclination may be moved from one frequency range to another as shown in FIG. 26 and FIG. 27. However, another possibility is that a rotation center may be on a frequency characteristic reference line as shown in FIG. 28. If a point 2802 on a frequency characteristic reference line 2801 is used as a rotation center, the inclination may be adjusted to be as 2803 or 2804. Likewise, if a point 2806 on a frequency characteristic reference line 2801 is used as a rotation center, the inclination may be adjusted to be as 2807 or 2808.

Figure 29:
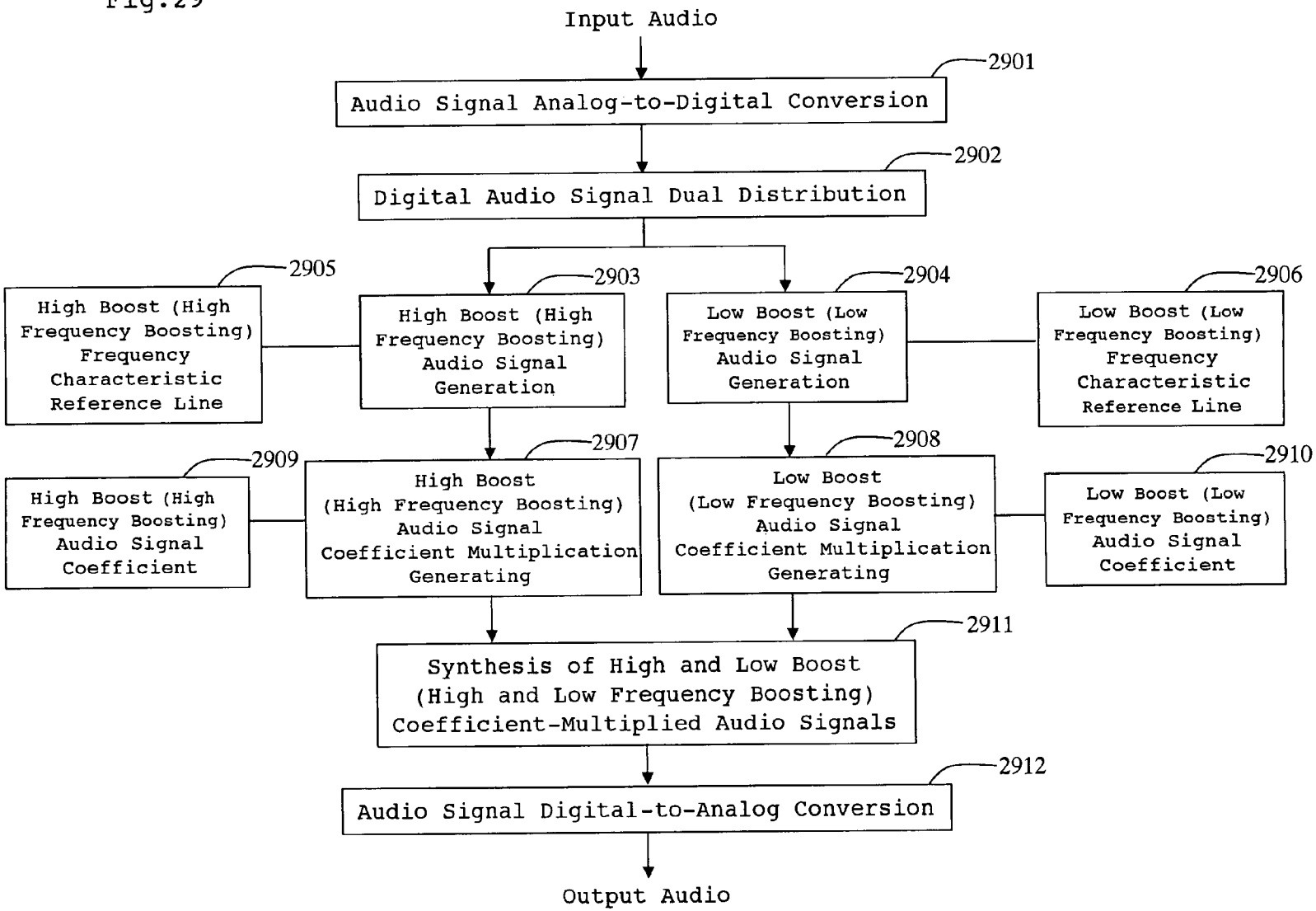
FIG. 29 is a flow diagram of an embodiment which has a plurality of adjustment mechanisms, according to the present invention.

Explained in more detail now of the aforementioned using a flow diagram as shown in FIG. 29, wherein, in sequence, audio signal input is analog-to-digital converted in 2901, the converted digital audio signal is dual distributed in 2902 to be used for audio signal generation. For the dual distributed digital audio signal, high frequency enhancing signal processing method is to refer to a high boost (high frequency boosting) frequency reference line 2905, and, by 2903, generates a high boost (high frequency boosting) audio signal, and a low frequency enhancing signal processing method is to refer to low boost (low frequency boosting) frequency reference line 2906, and, by 2904, generates a low boost (low frequency boosting) audio signal.

Gain control is made independently according to frequency range. Gain control of digital audio signal is made by increasing or decreasing according to user-adjusted high boost (high frequency boosting) and low boost (low frequency boosting) frequency characteristic reference lines, as described in the aforementioned embodiment.

Then, the generated high frequency enhanced high boost (high frequency boosting) audio signal refers to a high boost (high frequency boosting) audio signal coefficient 2909, and generates high boost (high frequency boosting) coefficient-multiplied audio signal at 2907. Likewise, the generated low frequency enhanced low boost (low frequency boosting) audio signal refers to a low boost (low frequency boosting) audio signal coefficient 2910, and generates low boost (low frequency boosting) coefficient-multiplied audio signal at 2908. And then, in 2911, the high boost (high frequency boosting) coefficient-multiplied audio signal and the low boost (low frequency boosting) coefficient-multiplied audio signal are synthesized and, as appropriate, is digital-to-analog converted at 2912 to be output as an audio signal.

Figure 30:
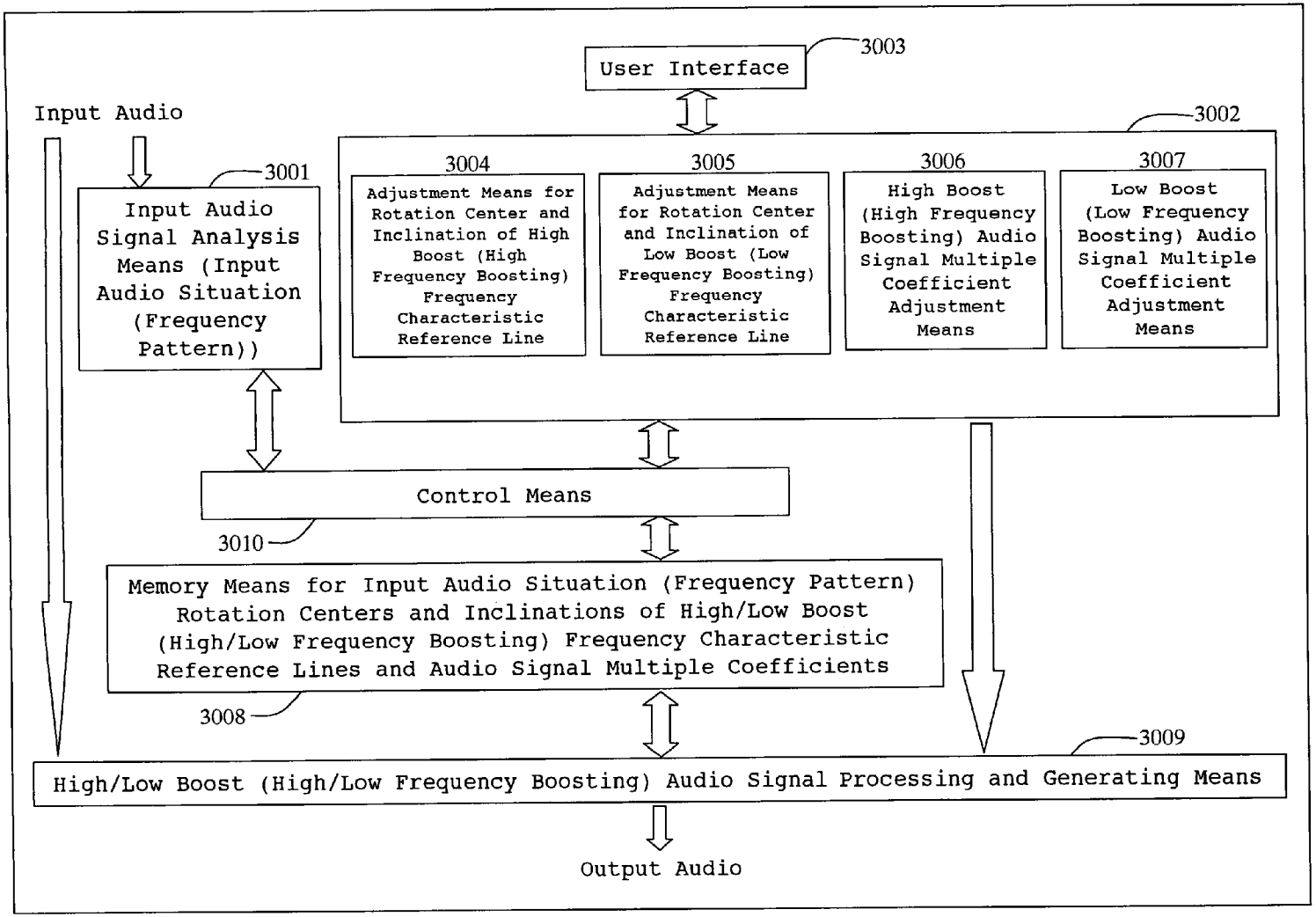
FIG. 30 is a block diagram showing adjustments corresponding to surrounding sound environments, according to the present invention.

Explained next is a method which requires no adjustment in such a case that a surrounding sound environment is similar to that of a preliminarily memorized frequency pattern. FIG. 30 displays its schematic block diagram. The input audio signal is frequency analyzed by an input audio signal analysis means 3001 and, through a control means 3010, is memorized in a memory means for input audio situation (frequency pattern), rotation center and inclinations of high/low frequency characteristic reference lines, and audio signal multiple coefficients 3008. In the above mentioned process, in sequence, rotary canters and inclinations of high boost (high frequency boosting) frequency characteristic reference line and low boost (low frequency boosting) frequency characteristic reference line are referred to, high/low boost (high/low frequency boosting) audio signals are generated, audio signal multiple coefficient is referred to, and high/low boost (high/low frequency boosting) audio signals are coefficient-multiplied to be synthesized to make an audio signal output.

The output audio, through a user interface 3003, and by a high/low boost (high/low frequency boosting) frequency characteristic reference line adjustment means, and a high/low boost (high/low frequency boosting) audio signal coefficient-multiplying adjustment means, adjusts high/low frequency characteristic reference lines and high/low boost (high/low frequency boosting audio signal multiple coefficient, as shown in 3002.

3004 in 3002 is a high boost (high frequency boosting) frequency characteristic reference line adjustment means. For drawing simplification purpose, rotation center adjustment and inclination adjustment for high boost (high frequency boosting) frequency characteristic reference line are described within a same text box. However, these are two different functions.

Likewise, 3005 in 3002 is a low boost (low frequency boosting) frequency characteristic reference line adjustment means. For drawing simplification purpose, rotation center adjustment and inclination adjustment for low boost (low frequency boosting) frequency characteristic reference line are described within a same text box. However, these are two different functions.

3006 in 3002 is a high boost (high frequency boosting) audio signal multiple coefficient adjustment means. 3007 in 3002 is a low boost (low frequency boosting) audio signal multiple coefficient adjustment means.

Information which is processed by the high/low boost (high/low frequency boosting) frequency characteristic adjustment means and also by the high/low boost (high/low frequency boosting) audio signal multiple coefficient adjustment means in 3002 is, by a control means 3010, together with the input audio situation (frequency pattern) which is frequency analyzed by the input audio signal analysis means 3001, memorized in a memory means 3008 for the input audio situation (frequency pattern) and the rotation center and inclinations of high/low boost (high/low frequency boosting) frequency characteristic reference lines, and audio signal multiple coefficients.

Figure 31:
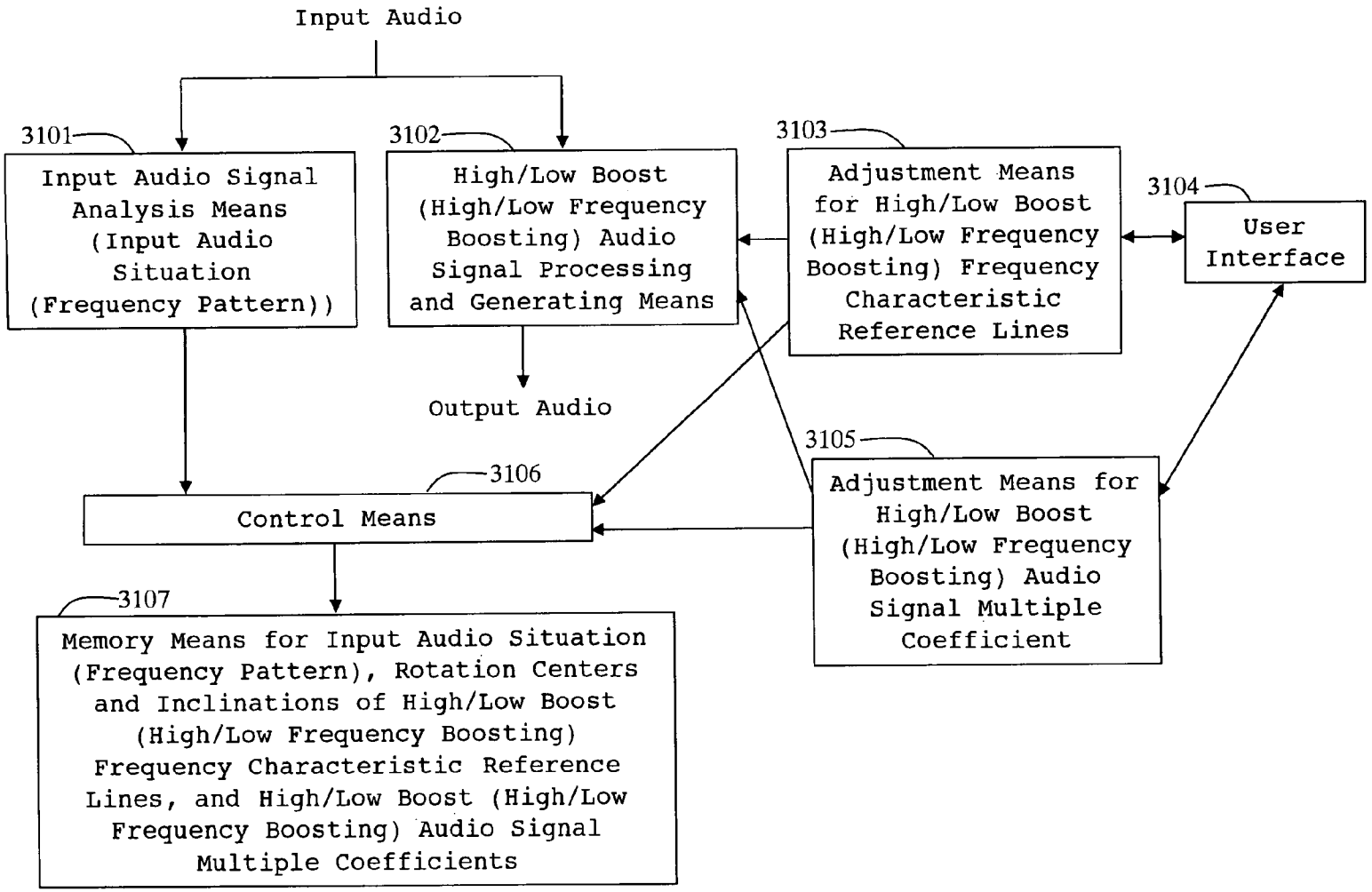
FIG. 31 is a flow diagram showing adjustments suited to user's specific sound environments, according to the present invention.

FIG. 31 is a flow diagram, illustrating how an input audio signal is memorized in memory means for input audio signal (input frequency pattern), rotation center and inclinations of high/low boost (high/low frequency boosting) frequency characteristic reference lines and audio signal multiple coefficients. The input audio signal is frequency analyzed by an input audio signal analysis means 3101 and is output as an input audio situation (frequency pattern). A user, while listening to the output audio generated by a high/low boost (high/low frequency boosting) audio signal processing and generating means 3102, through a user interface 3104, by an adjustment means 3103 for high/low boost (high/low frequency boosting) frequency characteristic reference lines and an adjustment means 3105 for high/low boost (high/low frequency boosting) audio signal multiple coefficient, adjusts high/low boost (high/low frequency boosting) frequency characteristic reference line rotation center, inclinations and audio signal multiple coefficients. The high/low boost (high/low frequency boosting) frequency characteristic reference line rotation center, inclinations and audio signal multiple coefficients, adjusted by the 3103 and the 3105, is, together with the input audio signal analysis means 3101, memorized in a memory means 3107 for input audio situation (frequency pattern), high/low boost (high/low frequency boosting) frequency characteristic reference lines rotation centers and inclinations, and high/low boost (high/low frequency boosting) audio signals multiple coefficients.

Explained next is a method, wherein surrounding sound environment situation (frequency pattern) is memorized in most suitable input audio situation and high/low boost (high/low frequency boosting) frequency reference lines rotation center and inclinations and audio signal multiple coefficient memory means, and then call the rotation center and inclinations of the high boost (high frequency boosting) frequency characteristic reference line and the low boost (low frequency boosting) frequency characteristic reference line, and high/low boost (high/low frequency boosting) audio signal multiple coefficient, and then an audio suitable to the corresponding surrounding sound environment is output.

Input audio signal is frequency analyzed by the input audio signal analysis means 3001 in FIG. 30, and by the control means 3010, examines whether a set of corresponding audio situation (frequency pattern) is being memorized in a memory means 3008 for input audio situation (frequency pattern) and high/low boost (high/low frequency boosting) frequency characteristic reference lines rotation centers and inclinations and audio signal multiple coefficients, and if there is one, calls and sends to a high/low boost (high/low frequency boosting) audio signal processing and generating means 3009 to make an audio output.

This input audio situation (frequency pattern) and high/low boost (high/low frequency boosting) frequency characteristic reference line inclination memory means, by being provided with a learning function, automatically adjusts to a user's specific sound environment as he/she continues to use the adjustment function.

However, an automatically called adjustment may not necessarily fit a user's hearing characteristic. In this case, adjustment is made through the user interface 3003 and by the adjustment means 3002. Control means 3010 monitors whether there is such an adjustment, and when there is one, without referring to the input audio situation (frequency pattern) and the high/low boost (high/low frequency boosting) frequency characteristic reference line inclination and audio signal multiple coefficient memory means 3008, audio signal is directly output by the high/low boost (high/low frequency boosting) audio signal processing and generating means 3009 after being adjusted by the adjustment means 3002.

Figure 32:
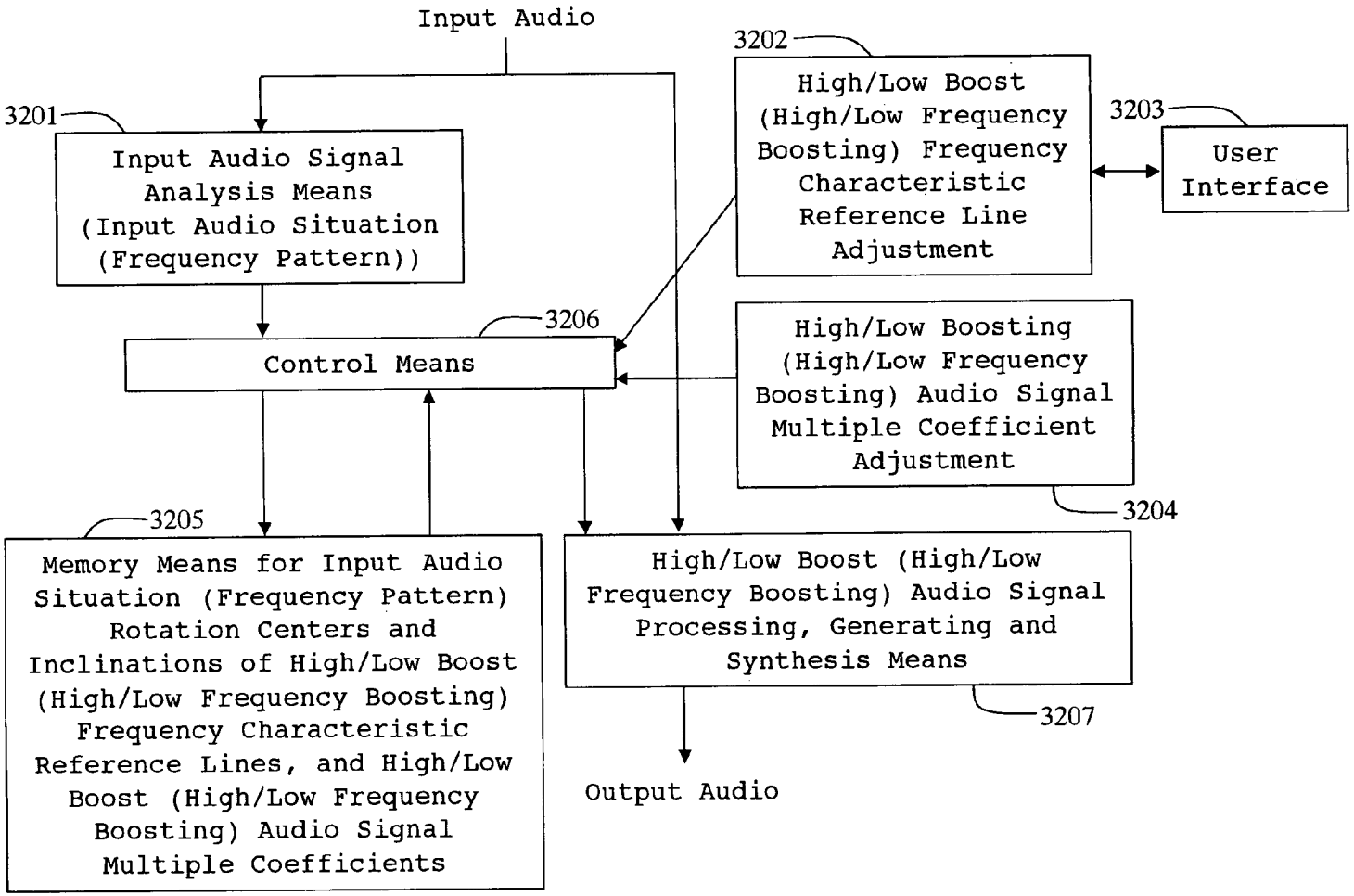
FIG. 32 is a flow diagram showing adjustments suited to user's other specific sound environments, according to the present invention.

In a flow diagram as shown in FIG. 32, in a control means 3206, a user, through a user interface 3203, monitors whether a high/low boost (high/low frequency boosting) frequency characteristic reference line adjustment 3202 and a high/low boost (high/low frequency boosting) audio signal multiple coefficient adjustment 3204 are being activated, and if they are, refers to information adjusted by adjustment means 3202 and 3204, controls in 3206, and outputs an audio signal by a high/low boost (high/low frequency boosting) audio signal processing, generating and synthesis means 3207.

If control means 3206, in its monitoring, determines that no adjustment is being made by 3202 and/or 3204, then audio signal being frequency analyzed in 3201 is recognized to measure input audio situation (frequency pattern) then by control means 3206, searches any corresponding data to this input audio situation (frequency pattern), from a memory means 3205 for an input audio situation (frequency pattern) and high/low boost (high/low frequency boosting) frequency reference lines rotation center and inclinations and high/low boost (high/low frequency boosting) audio signal multiple coefficients. Called data, if any, are sent to a high/low boost (high/low frequency boosting) audio signal processing, generating and synthesis means 3207 to be used as an audio signal output.

The memory means already memorizes input audio situation (frequency pattern) and high/low boost (high/low frequency boosting) frequency reference lines rotation center and inclinations and audio signal multiple coefficients, for various surrounding sound environment situation (frequency pattern), so that if an input audio is similar to any of the preliminarily memorized surrounding sound environment situation (frequency pattern), there is no need for adjustment, input audio signal and high/low boost (high/low frequency boosting) frequency reference lines rotation center and inclinations and audio signal multiple coefficients, being memorized together with the corresponding surrounding sound environment situation (frequency pattern), are called to be used as an audio output by the high/low boost (high/low frequency boosting) audio signal processing and generating means.

This embodiment requires a user to adjust according to his/her sound environment, however, it is also possible to preliminarily measure and memorize inclinations of high boost (high frequency boosting) frequency characteristic reference line and low boost (low frequency boosting) frequency characteristic reference line of a sound environment suited for average persons with normal hearing, and then, when needed, analyze input audio signal to call inclinations of corresponding high boost (high frequency boosting) characteristic reference line and low boost (low frequency boosting) characteristic reference line.

Figure 33:
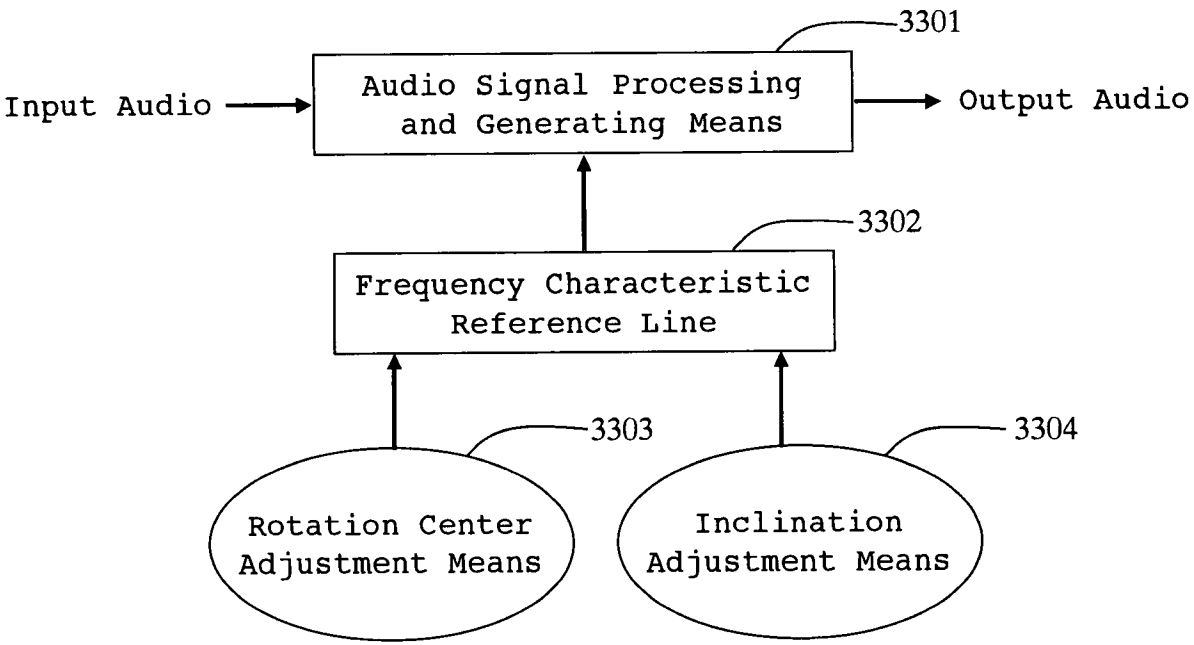
FIG. 33 is a schematic block diagram showing an embodiment of which frequency characteristic reference line is a single line, according to the present invention.
Figure 34:
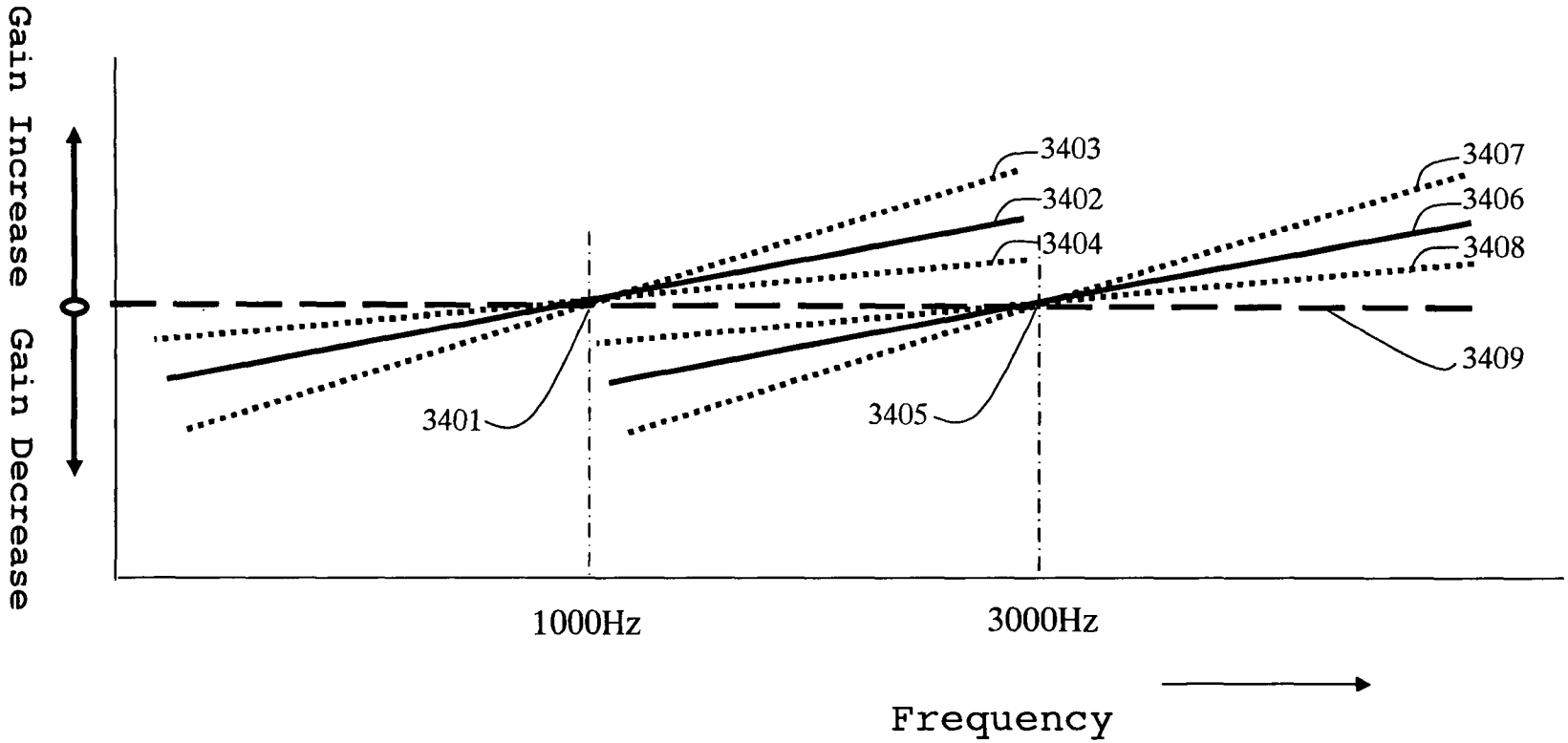
FIG. 34 is a graph showing adjustments of frequency characteristic reference lines, according to the present invention.

Explained next is about a case for a single frequency characteristic reference line. FIG. 33 is a schematic block diagram of another embodiment of the present invention. FIG. 34 shows frequency characteristic reference lines in accordance which enhancement level of input audio signal is determined according to frequency ranges. In FIG. 33, signal processing method of input audio signal is to refer to a frequency characteristic reference line 3302, and, by an audio signal processing and generating means 3301, generate an audio signal. FIG. 34 shows an example of frequency characteristic reference lines, wherein 3401 and 3405 are examples of rotation centers on frequency characteristic reference lines, which are adjusted by a frequency characteristic reference line rotation center adjustment means 3303, and a frequency characteristic reference line inclination adjustment means 3304, as shown in FIG. 33.

For adjustment of inclination, with a rotation center 3401 in FIG. 34, a frequency characteristic reference line 3402 may shift to 3403 by increasing the inclination, or may shift to 3404 by decreasing the inclination, likewise, with a rotation center 3406 in FIG. 34, a frequency characteristic reference line 3406 may shift to 3407 by increasing the inclination, or may shift to 3408 by decreasing the inclination, These adjustments are performed by a frequency characteristic reference line inclination adjustment means 3304 in FIG. 33.

Figure 35:
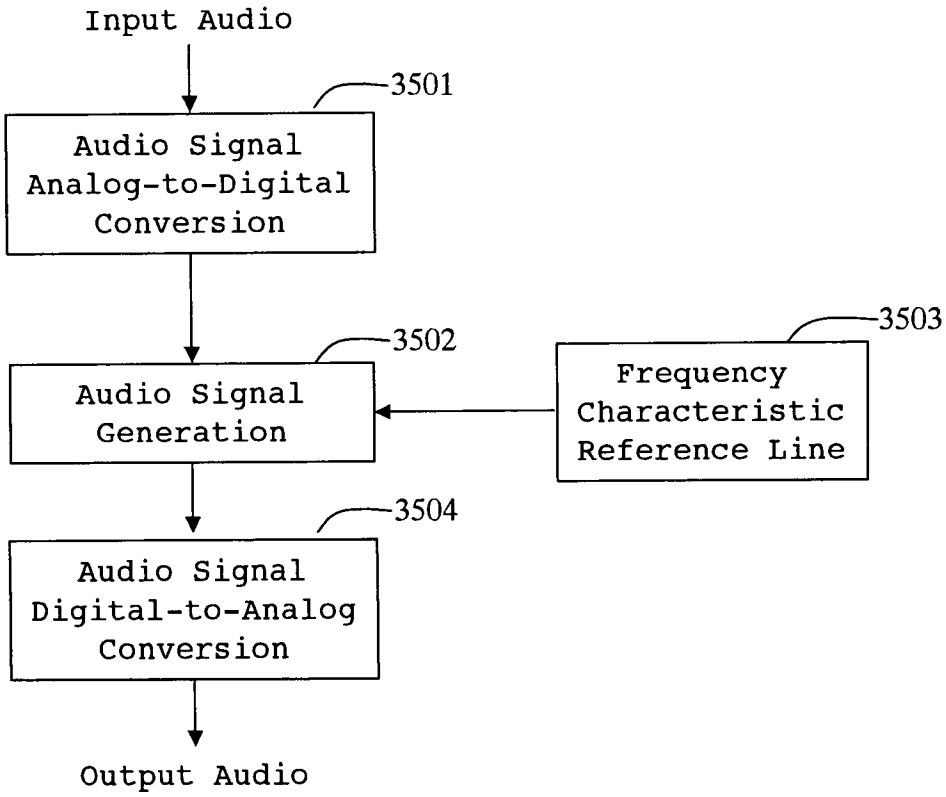
FIG. 35 is a flow diagram showing an embodiment of which frequency characteristic reference line is a single line, according to the present invention.

Explained in more detail now of the aforementioned using a flow diagram as shown in FIG. 35, wherein, in sequence, audio signal input is analog-to-digital converted in 3501 as needed, and the converted digital audio signal is, referring to a frequency characteristic reference line 3503, audio signal generated in 3502. Gain is adjusted independently according to frequency range, of which digital audio signal may be increased or decreased according to user-adjusted frequency characteristic reference line, which is shown in the aforementioned embodiment. Digital-to-analog conversion may be made in 3504, as needed, to make an audio output.

The aforementioned embodiment shows straight frequency characteristic reference lines to make explanations simple; however, those are not limited to straight lines but may be curved ones as appropriate.

What is claimed is:

1. A hearing optimization device, preliminarily providing a high boost (high frequency boosting) frequency characteristic reference line for high frequency emphasis and a low boost (low frequency boosting) frequency characteristic reference line for low frequency emphasis in order for separate gain control of an input audio signal according to frequency, having:

a synchronous adjustment means for the high boost (high frequency boosting) frequency characteristic reference line and the low boost (low frequency boosting) frequency characteristic reference line to synchronously adjust the two characteristic reference lines, namely the high boost (high frequency boosting) frequency characteristic reference line and the low boost (low frequency boosting) frequency characteristic reference line, by a pair of adjustment means;

an audio signal processing and generating means, whereby the input audio signal is dual distributed, and two audio signal processings are carried out for the high boost (high frequency boosting) audio signal to emphasize a high frequency range according to the high boost (high frequency boosting) frequency characteristic reference line and the low boost (low frequency boosting) audio signal to emphasize a low frequency range according to the low boost (low frequency boosting) frequency characteristic reference line; and a synthesized audio signal output means, wherein:

the two audio signals generated by the audio signal processing and generating means are synthesized to be used as an audio signal output;

the high boost (high frequency boosting) frequency characteristic reference line and the low boost (low frequency boosting) frequency characteristic reference line are crossed at a memorized frequency;

synchronous emphasis is carried out by changing inclinations of the high boost (high frequency boosting) frequency characteristic reference line and the low boost (low frequency boosting) frequency characteristic reference line, the crossing point being a rotation center; and the adjustment means, which synchronously adjusts the high boost (high frequency boosting) frequency characteristic reference line and the low boost (low frequency boosting) frequency characteristic reference line with each other, adjusts the high boost (high frequency boosting) frequency characteristic reference line and the low boost (low frequency boosting) frequency characteristic reference line in symmetrical inclination to each other, the crossing point being a rotation center where the high boost (high frequency boosting) frequency characteristic reference line and the low boost (low frequency boosting) characteristic reference line are crossed with each other.

2. The hearing optimization device as claimed in claim 1, wherein:

a memorized crossing frequency range for the high boost (high frequency boosting) frequency characteristic reference line and the low boost (low frequency boosting) frequency characteristic reference line is between 500 Hz and 2 kHz.

3. The hearing optimization device as claimed in claim 1, having:

an input audio analysis and memory means, whereby the audio input signal is analyzed and input audio information is memorized;

a memory means for input audio situation and inclinations of high boost (high frequency boosting) and low boost (low frequency boosting) frequency characteristic reference lines, which memorizes inclinations of high boost (high frequency boosting) frequency characteristic reference line and low boost (low frequency boosting) frequency characteristic reference line, adjusted by a user using the adjustment means, simultaneously with the input audio analysis and memory means; and an automatic adjustment means for inclinations of high boost (high frequency boosting) and low boost (low frequency boosting) frequency characteristic reference lines, whereby input audio signal is analyzed, and whereby an audio situation pattern similar to that of corresponding input audio situation is selected from the memory means for input audio situation and inclinations of high boost (high frequency boosting) and low boost (low frequency boosting) frequency characteristic reference lines, and whereby inclinations of the high boost (high frequency boosting) and the low boost (low frequency boosting) frequency characteristic reference lines are determined without any user adjustment.

4. The hearing optimization device as claimed in claim 3, wherein:

the automatic adjustment means for inclinations of the high boost (high frequency boosting) and low boost (low frequency boosting) frequency characteristic reference lines has a learning function.

5. The hearing optimization device as claimed in claim 3, wherein:

the analysis means to analyze the input audio signal is a frequency analysis means.

6. The hearing optimization device as claimed in claim 1, further having:

an input audio analysis means to analyze the input audio signal and to recognize the input audio situation; and a memory means for inclinations of the high boost (high frequency boosting) and low boost (low frequency boosting) frequency characteristic reference lines corresponding to the audio situation, wherein:

inclinations of high boost (high frequency boosting) frequency characteristic reference line and low boost (low frequency boosting) frequency characteristic reference line corresponding to memorized input audio situation are memorized preliminarily.

7. The hearing optimization device as claimed in claim 6, wherein:

the analysis means to analyze the input audio signal is a frequency analysis means.

8. The hearing optimization device as claimed in claim 1, wherein:

the hearing optimization device are applied to hearing aid.

9. The hearing optimization device as claimed in claim 8, wherein:

the adjustment means is controllable independently from an audio signal output adjustment means;

the audio signal output adjustment means and the adjustment means are adjusted by a same mechanical adjustment device;

the mechanical adjustment device is provided with an audio output adjustment means and a mechanical adjustment selection means for adjustment and selection; and the two means are for selection of either one of the audio output adjustment means or the adjustment means for frequency adjustment.

10. The hearing optimization device as claimed in claim 8, wherein:

the hearing aid has a unified construction attached to an ear; and the adjustment means is provided within the unified construction.

11. The hearing optimization device as claimed in claim 8, wherein:

the hearing aid is composed of a hearing aid remote control unit and an ear attachment unit, each of the hearing aid remote control unit and the ear attachment unit has a communication means to communicate with each other either by wired or short-range radio communication, the adjustment means being provided within the hearing aid remote control unit.

12. The hearing optimization device as claimed in claim 1, wherein:

the hearing optimization device is applied to a telecommunication means.

13. The hearing optimization device as claimed in claim 12, wherein:

the telecommunication means is a telephone.

14. The hearing optimization device as claimed in claim 12, wherein:

the hearing optimization device is of unified construction; and the adjustment means is provided within the unified construction.

15. The hearing optimization device as claimed in claim 12, wherein:

the hearing optimization device is independent from the telecommunication means; and the hearing optimization device and the telecommunication means are interfaced with a wired or short-range radio communication means.

16. The hearing optimization device as claimed in claim 1, further having:

a background-noise adaptation means which decreases gain of a memorized frequency range of memorized background noises; and a background noise adaptation activation means with which a user can activate the background noise adaptation means over the input audio.

17. The hearing optimization device as claimed in claim 1, wherein:

in order to be used in noisy environment places, the hearing optimization device has a background-noise recognition means to measure whether or not any background-noise of a memorized frequency is present;

a background-noise adaptation activation means which decreases gain of a memorized frequency range; and an automatic background-noise adaptation activation means to activate the background-noise muting means when the background-noise recognition means recognizes that there is some noise.

18. The hearing optimization device as claimed in claim 16, wherein:

a memorized frequency range of the background noises for the background-noise adaptation means is between 20 Hz and 500 Hz.

* * * * *